US009535366B2

(12) United States Patent
Ebe

(10) Patent No.: US 9,535,366 B2
(45) Date of Patent: Jan. 3, 2017

(54) IMAGE FORMING UNIT AND IMAGE FORMING APPARATUS

(71) Applicant: Oki Data Corporation, Tokyo (JP)

(72) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/973,854

(22) Filed: Dec. 18, 2015

(65) Prior Publication Data

US 2016/0274494 A1 Sep. 22, 2016

(30) Foreign Application Priority Data

Mar. 20, 2015 (JP) ..... 2015-057715

(51) Int. Cl.
*G03G 15/08* (2006.01)

(52) U.S. Cl.
CPC ..... *G03G 15/0865* (2013.01)

(58) Field of Classification Search
CPC ..... G03G 15/0818; G03G 2215/0177; G03G 2215/0634; G03G 7/00; G03G 15/0812; G03G 15/162; G03G 15/5058; G03G 15/556; G03G 2215/0861; G03G 2215/0863; G03G 9/0825; G03G 9/0827; G03G 9/08755
See application file for complete search history.

(56) References Cited

U.S. PATENT DOCUMENTS 6,345,166 B1 * 2/2002 Sakaizawa ..... G03G 15/0815 399/283
2009/0231717 A1 * 9/2009 Mizutani ..... C08L 51/04 359/620
2011/0097585 A1 * 4/2011 Miyazawa ..... C08F 220/16 428/411.1

FOREIGN PATENT DOCUMENTS

JP 2007093775 A 4/2007

* cited by examiner

*Primary Examiner* — Roy Y Yi
(74) *Attorney, Agent, or Firm* — Panitch Schwarze Belisario & Nadel LLP

(57) ABSTRACT

Provided is an image forming unit that includes: an image supporting member including a photosensitive layer configured to support a latent image; a developer supporting member configured to support a developer, and perform a development process on the latent image with use of the developer; and a developer feeding member including a surface that comes into contact with the developer supporting member, and configured to feed the developer to the developer supporting member. The developer feeding member includes an elastic layer. The elastic layer has a plurality of cells each including an opening that is exposed on the surface, and an area occupancy rate of the openings in area of the surface is in a range from 40% to 85%.

19 Claims, 7 Drawing Sheets

IMAGE FORMING UNIT AND IMAGE FORMING APPARATUS

CROSS REFERENCE TO RELATED APPLICATIONS

This application claims the benefit of Japanese Priority Patent Application JP2015-057715 filed on Mar. 20, 2015, the entire contents of which are incorporated herein by reference.

BACKGROUND

The invention relates to an image forming unit that forms an image using an electrophotographic process, and an image forming apparatus that includes the image forming unit.

There has been proposed an image forming apparatus that performs exposure to form an electrostatic latent image on a photosensitive drum and attaches a toner onto the electrostatic latent image to perform development. For example, reference is made to Japanese Unexamined Patent Application Publication No. 2007-93775.

SUMMARY

In general, an image forming apparatus includes a developing roller adapted to perform development of a toner on an electrostatic latent image formed on a photosensitive drum, and a toner feeding roller that feeds the toner to the developing roller. To form an image of higher quality, it is desirable that a performance of the toner feeding roller, including an amount of the toner to be fed to the developing roller, be stable, and that a resistance to abrasion of the toner feeding roller be high as well.

It is desirable to provide an image forming unit and an image forming apparatus that make it possible to form a higher-quality image.

An image forming unit according to an embodiment of the invention includes: an image supporting member including a photosensitive layer, in which the photosensitive layer is configured to support a latent image; a developer supporting member configured to support a developer, and perform a development process on the latent image with use of the developer; and a developer feeding member including a surface that comes into contact with the developer supporting member, and configured to feed the developer to the developer supporting member. The developer feeding member includes an elastic layer. The elastic layer has a plurality of cells each including an opening that is exposed on the surface. An area occupancy rate of the openings in area of the surface is in a range from 40% to 85%.

An image forming apparatus according to an embodiment of the invention is provided with a printing medium feeding section and an image forming unit, in which the printing medium feeding section is configured to feed a printing medium, and the image forming unit is configured to form an image on the printing medium fed from the printing medium feeding section. The image forming unit includes: an image supporting member including a photosensitive layer, in which the photosensitive layer is configured to support a latent image; a developer supporting member configured to support a developer, and perform a development process on the latent image with use of the developer; and a developer feeding member including a surface that comes into contact with the developer supporting member, and configured to feed the developer to the developer supporting member. The developer feeding member includes an elastic layer. The elastic layer has a plurality of cells each including an opening that is exposed on the surface. An area occupancy rate of the openings in area of the surface is in a range from 40% to 85%.

The image forming unit and the image forming apparatus according to the above-described respective embodiments of the invention make it possible to form a higher-quality image.

It is to be understood that both the foregoing general description and the following detailed description are exemplary, and are intended to provide further explanation of the invention as claimed. Also, effects of the invention are not limited to those described above. Effects achieved by the invention may be those that are different from the above-described effects, or may include other effects in addition to those described above.

DETAILED DESCRIPTION

In the following, some example embodiments of the invention are described in detail, in the following order, with reference to the accompanying drawings. Note that the following description is directed to illustrative examples of the invention and not to be construed as limiting to the invention. Also, factors including, without limitation, arrangement, dimensions, and a dimensional ratio of elements illustrated in each drawing are illustrative only and not to be construed as limiting to the invention.

1. Example Embodiment, directed to an image forming unit and an image forming apparatus each having a toner feeding roller that includes a foamed elastic layer and a coating layer.
2. Examples
3. Modification Examples

[1. Example Embodiment]

[Configuration of Developing Unit 11]

Figure 1:
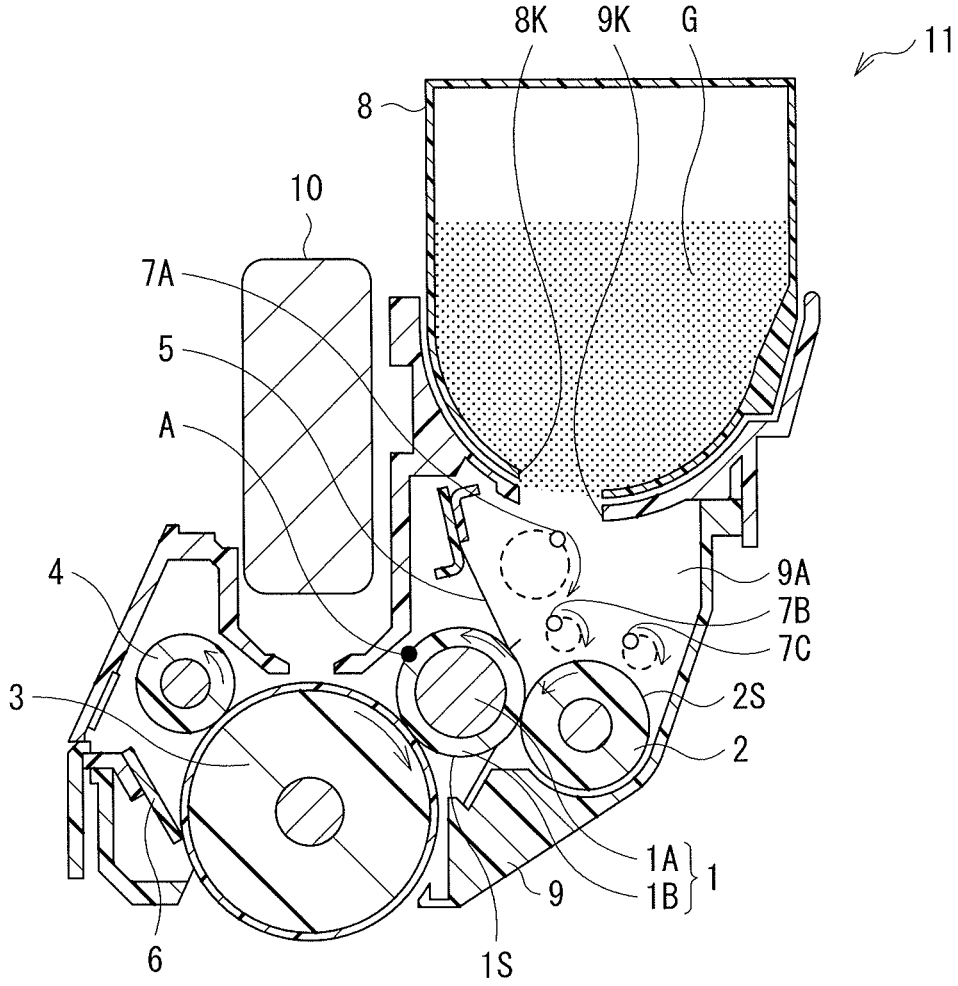
FIG. 1 schematically illustrates an example of a configuration of an image forming unit according to an example embodiment of the invention.

FIG. 1 schematically illustrates an example of an outline configuration of a developing unit 11 according to an example embodiment of the invention. The developing unit 11 may use a toner G to form a toner image, and may be mounted on an electrophotographic image forming apparatus. For example, the image forming apparatus may form an image, which may be a black image, on a recording medium. The recording medium may also be referred to as a "print medium" or a "transfer member", and may be, for example but not limited to, paper. The developing unit 11 and a later-described transfer roller 34 may form a concrete but non-limiting example of an "image forming unit" in one embodiment of the invention.

The toner G may be configured by non-magnetic materials including a binder, internal additives, and an external additive. The binder may be, for example but not limited to, a polyester resin. The internal additives may include a charge control agent, a release agent, and a colorant. The external additive may be, for example but not limited to, silica or a titanium oxide. Among these materials, a color of the colorant may be selected on an as-needed basis to change a color of the toner image to be formed by the developing unit 11. The toner G may form a concrete but non-limiting example of a "developer" in one embodiment of the invention.

The developing unit 11 may include a developing roller 1, a toner feeding roller 2, a photosensitive drum 3, a charging roller 4, a doctor blade 5, a cleaning blade 6, the toner G, stirring members 7A to 7C, a toner containing section 8, a casing 9, and a light-emitting diode (LED) head 10.

The toner containing section 8 may be a container adapted to store the toner G, and may have a toner outlet 8K at a lower part thereof. The toner containing section 8 may be mounted at an upper part of the casing 9.

The casing 9 may be provided therein with internal space 9A through which the toner G passes, and have a toner inlet 9K at a position that faces the toner outlet 8K of the toner containing section 8, allowing the toner G to be fed from the toner containing section 8. The developing roller 1, the toner feeding roller 2, the photosensitive drum 3, the charging roller 4, the doctor blade 5, the cleaning blade 6, and the stirring members 7A to 7C may be provided in the internal space 9A of the casing 9.

The stirring members 7A to 7C each may be a crank-shaped rotary member and configured to stir the toner G fed into the internal space 9A of the casing 9 from the toner inlet 9K. The stirring members 7A to 7C may be rotated in the same direction as each other as denoted by their respective arrows in FIG. 1 (rotated clockwise in FIG. 1 without limitation), for example.

The developing roller 1 may be a member that supports the toner G to feed the toner G to the photosensitive drum 3 and performs development of the toner G on the electrostatic latent image supported on a surface of the photosensitive drum 3. The developing roller 1 may be so disposed to face the photosensitive drum 3 as to be in contact with the photosensitive drum 3. The developing roller 1 may be so provided as to work its way into the photosensitive drum 3 by 0.8 mm without limitation. For example, the developing roller 1 may include a cored bar 1A, and an elastic layer 1B that covers an outer circumference part (a surface) of the cored bar 1A. The cored bar 1A may be made of a metal material having an excellent electrical conductivity, including iron (Fe), aluminum (Al), and a stainless steel without limitation. The elastic layer 1B may be made of a rubber material including a silicone rubber and urethane without limitation. A more specific but non limiting example of a material of the elastic layer 1B may be a material in which polyester-based polyol and aliphatic isocyanate serve as base polymers. The elastic layer 1B may contain carbon black as a conducting agent to adjust an electrical resistance thereof. Non-limiting examples of the carbon black may include acetylene black and Ketjen black. Further, the elastic layer 1B may have a surface 1S that has been subjected to an isocyanate treatment to achieve a more-uniform charging property at the surface 1S of the developing roller 1 and thereby to allow the developing roller 1 to support the toner G appropriately. The isocyanate treatment may be based on an isocyanate treatment liquid in which any carbon black, such as any of those described above, is added to a solution that contains an organic solvent and an isocyanate compound dissolved in the organic solvent. A non-limiting example of the organic solvent may be ethyl acetate without limitation. Non-limiting examples of the isocyanate compound may include diphenylmethane isocyanate, p-phenylene diisocyanate, and tolylene diisocyanate. To perform the isocyanate treatment, the surface 1S of the elastic layer 1B may be applied with the isocyanate treatment liquid and then dried, followed by wiping of the surface 1S of the elastic layer 1B using, without limitation, a cloth in which isopropyl alcohol is impregnated. In the example embodiment, the developing roller 1 may be rotated anticlockwise, i.e., rotated in the opposite direction to the photosensitive drum 3, as denoted by a corresponding arrow in FIG. 1. The developing roller 1 may form a concrete but non-limiting example of a "developer supporting member" in one embodiment of the invention.

The photosensitive drum 3 may be a cylindrical member that extends in a lateral direction, and may serve as an electrostatic latent image supporting member that supports the electrostatic latent image on a surface (a superficial part) of the photosensitive drum 3. In the example embodiment, the photosensitive drum 3 may be rotated clockwise as denoted by a corresponding arrow in FIG. 1. The photosensitive drum 3 may form a concrete but non-limiting example of an "image supporting member" in one embodiment of the invention. The electrostatic latent image may form a concrete but non-limiting example of a "latent image" in one embodiment of the invention.

Figure 2:
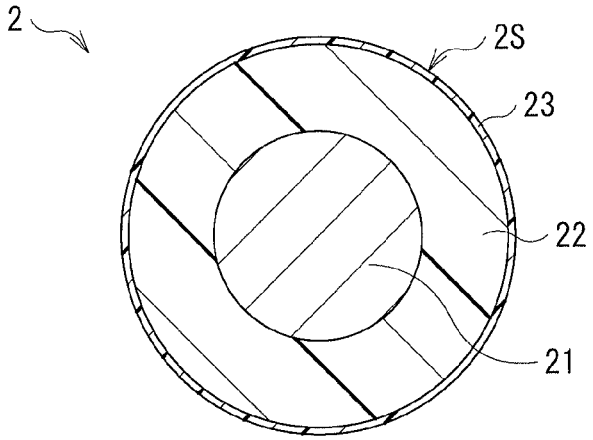
FIG. 2 schematically illustrates an essential part of the image forming unit illustrated in FIG. 1 in an enlarged manner.
Figure 3:
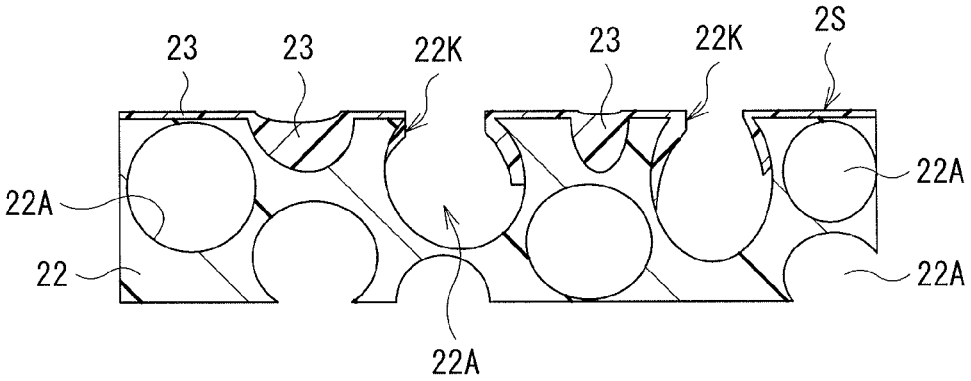
FIG. 3 is a further-enlarged cross-sectional view of a toner feeding roller illustrated in FIG. 2.

The toner feeding roller 2 may have a surface 2S that comes into contact with the surface 1S of the developing roller 1, and serves as a "developer feeding member" that feeds the toner G to the developing roller 1. FIG. 2 is a cross-sectional view of the toner feeding roller 2, and FIG. 3 is an enlarged cross-sectional view of a part of the toner feeding roller 2. Referring to FIG. 2, the toner feeding roller 2 may have a three-layer structure including a cored bar 21, an elastic layer 22 that covers an outer circumference part (a surface) of the cored bar 21, and a coating layer 23 that covers an outer circumference part (a surface) 22S of the elastic layer 22, for example. The elastic layer 22 may have a single layer structure of a thickness in a range from about 2 mm to about 20 mm without limitation. In the example embodiment, the toner feeding roller 2 may be rotated anticlockwise, i.e., rotated in the same direction as the developing roller 1, as denoted by a corresponding arrow in FIG. 1. An amount C by which the toner feeding roller 2 works its way into the developing roller 1 (i.e., a nip amount C) may be in a range from 0.6 mm to 1.3 mm without limitation. The nip amount C may be a value represented by (A−B), where A is the sum in mm of a radius of the developing roller 1 and a radius of the toner feeding roller 2, and B is a distance in mm from the center of rotation of the developing roller 1 to the center of rotation of the toner feeding roller 2. In other words, the developing roller 1 and the toner feeding roller 2 may be so configured as to satisfy the following conditional expression (1).

$$0.6\ \text{mm} \leq (A-B) \leq 1.3\ \text{mm} \quad (1)$$

The cored bar 21 may be made of a metal material having an excellent electrical conductivity, including iron (Fe), aluminum (Al), a sulfur free-cutting steel ("SUM" according to the Japanese Industrial Standards (JIS)), and a stainless steel without limitation.

The elastic layer 22 may be made of, for example, a foamed elastic material having a plurality of cells (e.g., voids) 22A therein. A non-limiting example of the material of the elastic layer 22 may be a rubber material, including a foamed silicone rubber and foamed urethane. The elastic layer 22 may have a configuration in which the cells 22A are independent from each other without being in contact or in communication with each other (i.e., the cells 22A are in a "cell independent state"). Alternatively, the elastic layer 22 may have a configuration in which the cells 22A are in communication with each other (i.e., the cells 22A are in a "cell communication state"), or a configuration in which the cell independent state and the cell communication state are mixed together. The Asker F hardness of the elastic layer 22 may be preferably in a range from 40 degrees to 70 degrees without limitation, and may be preferably in a range from 48 degrees to 63 degrees without limitation. The Asker F hardness as used herein refers to the hardness measured by an Asker F hardness tester available from Kobunshi Keiki Co., Ltd. located in Kyoto, Japan. Hence, a mean diameter of the cells 22A in the elastic layer 22 may be in a range from about 150 μm to about 400 μm without limitation. For example, the mean diameter of the cells 22A may be obtained as a result of observation, with use of a digital microscope, of a 2 mm by 2 mm square region (a region having the area of 4 $mm^2$) in any cutting plane of the elastic layer 22, measurement of a maximum length of each opening within the observed region, and averaging of the measured maximum lengths of the openings.

The rubber material structuring the elastic layer 22 may contain various additive agents on an as-needed basis besides a rubber, a foaming agent, and an electrical conductivity imparting agent. The rubber as used herein may be, for example but not limited to, a silicone rubber or a silicone modified rubber which is superior in heat resistance and charging property. The foaming agent may be any foaming agent in general used for a foamed rubber, including an inorganic foaming agent and an organic foaming agent. The inorganic foaming agent may be, for example but not limited to, sodium bicarbonate or ammonium carbonate. The organic foaming agent may be typified by an organic azo compound which may be, for example but not limited to, a diazo-amino derivative, an azonitrile derivative, or an azodicarboxylic acid derivative. The use of the inorganic foaming agent is appropriate when causing the elastic layer 22 to have the cells 22A that are in the cell communication state, whereas the use of the organic foaming agent is appropriate when causing the elastic layer 22 to have the cells 22A that are in the cell independent state. Also, in the rubber material structuring the elastic layer 22, a hollow filler may be used in addition to or in place of the foaming agent. A non-limiting example of the hollow filler may be an electrically-conductive polymer, besides conductive carbon black such as, but not limited to, Ketjen black and acetylene black. Non-limiting examples of the various additive agents may include a filler, a colorant, and a release agent, which may be so mixed as to be in a desired mixing amount. A foamed electrically-conductive silicone-rubber-based composition, which makes it possible to form the cell independent state, is particularly preferable, without limitation, for the rubber material structuring the elastic layer 22. Such a foamed electrically-conductive silicone-rubber-based composition, which makes it possible to form the cell independent state, is superior in heat resistance, durability, and resistance to residual distortion, and thus is preferable, without limitation, as the elastic layer 22 of the toner feeding roller 2. The elastic layer 22 may have an expansion rate in a range from 300% to 450% without limitation. The elastic layer 22 having such an expansion rate makes it possible to achieve the preferable Asker F hardness described above easily and to keep the hardness of the elastic layer 22 stably. The expansion rate of the elastic layer 22 and a diameter of each cell 22A may be adjusted by changing an additive amount of the foaming agent contained in the rubber material structuring the elastic layer 22, or changing a hardening condition of the rubber material. The expansion rate may be calculated from a ratio "ρ/ρf" of a density ρ before foaming to a density ρf after the foaming.

The coating layer 23 may contain a methylphenyl-based silicone resin and an electrical conductivity imparting agent. Containing the methylphenyl-based silicone resin allows the coating layer 23 to effectively exhibit charging property required for the toner feeding roller 2. The methylphenyl-based silicone resin may be a resin that contains a methyl group and a phenyl group as organic groups bonded to a silicon atom. For example, methylphenyl-based silicone resin may be a resin in which the methyl group and the phenyl group are bonded to the same silicon atom. In one embodiment, the methylphenyl-based silicone resin used for the coating layer 23 may have the JIS-A hardness according to the Japanese Industrial Standards (JIS) in a range from 50 degrees to 80 degrees where a thickness of the methylphenyl-based silicone resin in a flat-plate specimen is 7 mm. The electrical conductivity imparting agent of the coating layer 23 may be the carbon black without limitation. The content of the electrical conductivity imparting agent in the coating layer 23 may be in a range from 2 pts·mass (parts by mass) to 10 pts·mass with respect to 100 pts·mass of the methylphenyl-based silicone resin. Also, factors including abrasion resistance, flexibility that makes it possible to follow deformation of the elastic layer 22, and a charge property with respect to the toner G are required for the coating layer 23. Besides a material that contains primarily the methylphenyl-based silicone resin described above, a non-limiting example of a constituent material of the coating layer 23 that satisfies such requirements may include a material that contains primarily a methyl-based silicone resin, a methylphenyl-based silicone resin, a urethane modified silicone, a urethane resin, or an acrylic resin.

Some of the plurality of cells 22A have their respective openings 22K that are exposed on the surface 2S of the toner feeding roller 2. In other words, the coating layer 23 may be so provided as to fill a part of the cells 22A present on the surface 22S, while covering a part of an inner surface of each of the remaining cells 22A present on the surface 22S without covering their respective openings 22K. Hence, a region in which the elastic layer 22 is coated with the coating layer 23 and a region in which the openings 22K of the respective cells 22A of the elastic layer 22 are exposed without being coated with the coating layer 23 may be provided in a mixed fashion on the surface 2S of the toner feeding roller 2. In one embodiment, a rate of occupancy of area (an area occupancy rate) of the openings 22K in which the openings 22K occupy out of the area of the surface 2S of the toner feeding roller 2 may be in a range from 40% to 85% without limitation.

For example, the toner feeding roller 2 may have an electrical resistance in a range from about $1\times10^4\Omega$ to about $1\times10^7\Omega$ upon application of − (minus) 100 V without limitation.

The charging roller 4 may be a member (i.e., a charging member) that charges the surface (the superficial part) of the photosensitive drum 3, and may be so disposed as to be in contact with the surface (a circumferential surface) of the photosensitive drum 3. The charging roller 4 may include a metal shaft, and a semi-conductive rubber layer that covers an outer circumference part (a surface) of the metal shaft, for example. The semi-conductive rubber layer may be, for example but not limited to, a semi-conductive epichlorohydrin rubber layer. In the example embodiment, the charging roller 4 may be rotated anticlockwise, i.e., rotated in an opposite direction to the photosensitive drum 3, as denoted by a corresponding arrow in FIG. 1.

The doctor blade 5 may be a toner regulating member that forms a layer made of the toner G (i.e., a toner layer) on the surface 1S of the rotating developing roller 1 while regulating (controlling or adjusting) a thickness of the toner layer. The doctor blade 5 may be a plate-shaped elastic member (a plate spring) which may be made of, for example but not limited to, a stainless steel, and may be so disposed that a tip of the plate-shaped elastic member comes into slight contact with the surface 1S of the developing roller 1.

The cleaning blade 6 may be a member that scrapes the toner G remaining on the surface (the superficial part) of the photosensitive drum 3 to clean the surface of the photosensitive drum 3. The cleaning blade 6 may be so disposed to counter-face the photosensitive drum 3 as to come into contact with the surface of the photosensitive drum 3, i.e., so disposed as to protrude in a direction opposite to the direction of rotation of the photosensitive drum 3. The cleaning blade 6 may be made of an elastic body such as, but not limited to, a polyurethane rubber.

The LED head 10 may be a unit that performs exposure of the surface of the photosensitive drum 3 to form the electrostatic latent image on the surface (the superficial part) of the photosensitive drum 3. The LED head 10 may include a plurality of LED light emitting sections that are arrayed in the lateral direction relative to the corresponding photosensitive drum 3. The LED head 10 may form a concrete but non-limiting example of an "exposure unit" in one embodiment of the invention.

[Configuration of Image Forming Apparatus]

Figure 4:
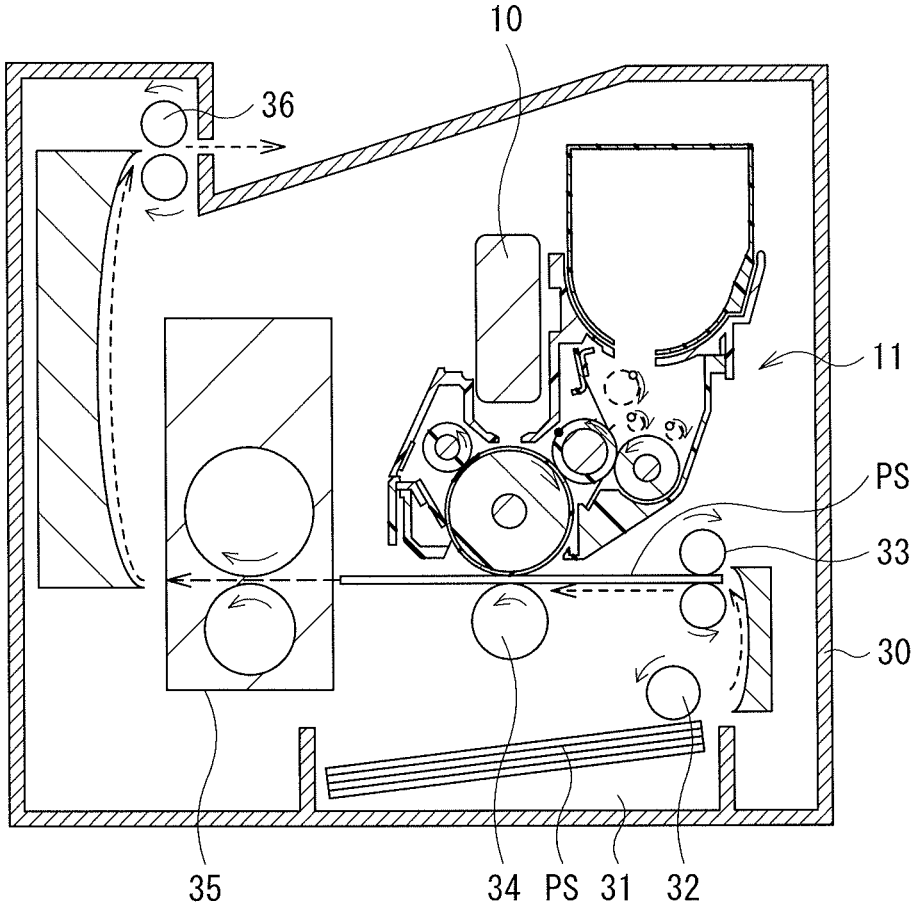
FIG. 4 schematically illustrates an example of an overall configuration of an image forming apparatus that includes the image forming unit illustrated in FIG. 1.
Figure 5:
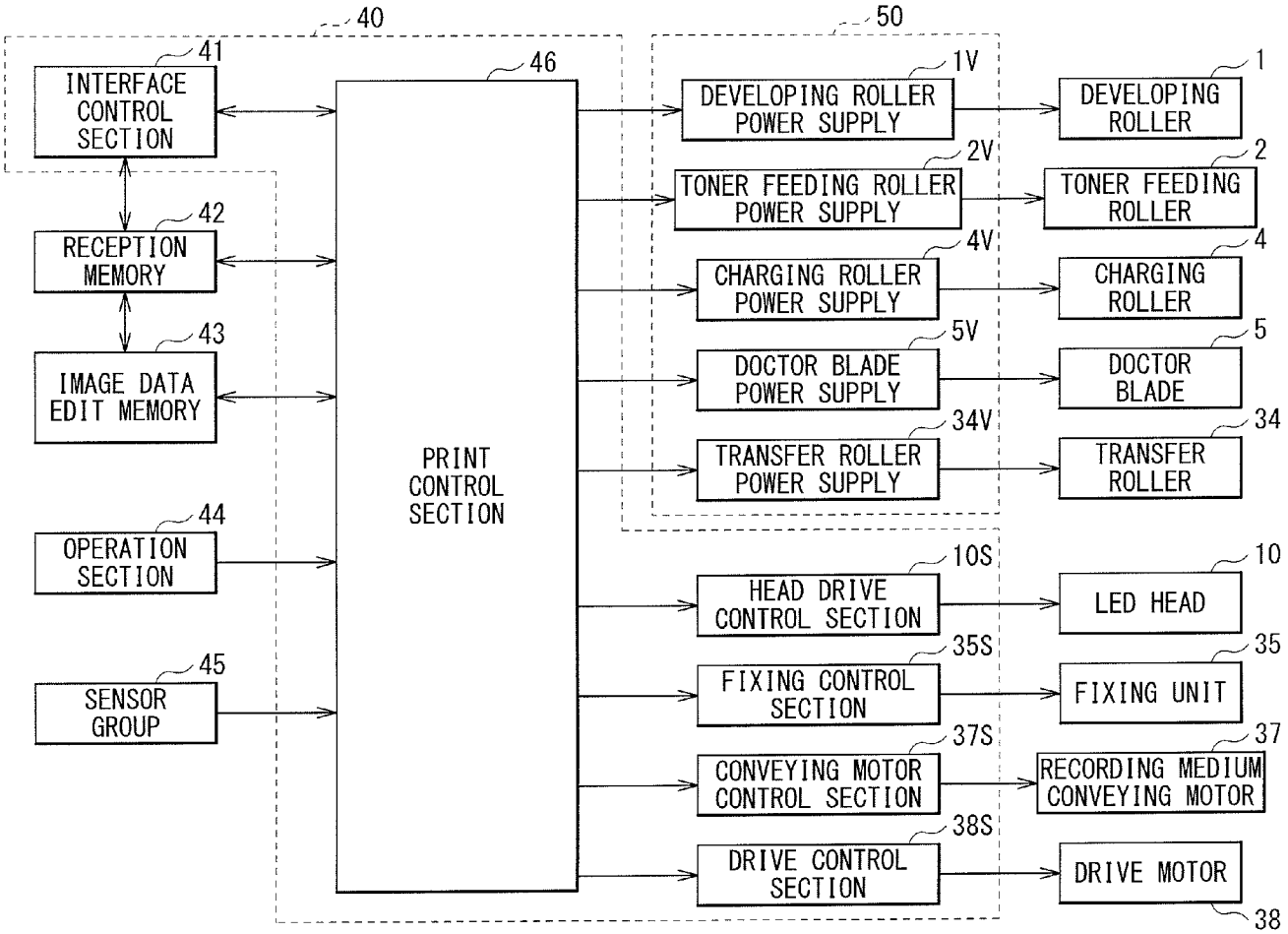
FIG. 5 is a block diagram schematically illustrating an example of a configuration inside the image forming apparatus illustrated in FIG. 4.

FIG. 4 schematically illustrates an example of an overall configuration of an image forming apparatus that includes the developing unit 11. FIG. 5 is a block diagram corresponding to the image forming apparatus illustrated in FIG. 4. The image forming apparatus may be, without limitation, an electrophotographic printer that forms an image, which may be a black image, on a recording medium PS. The recording medium PS may also be referred to as a "print medium" or a "transfer member", and may be, for example but not limited to, paper.

The developing unit 11 in the image forming apparatus may form an monochrome toner image with use of a black (K: blacK) toner.

Referring to FIG. 4, besides the developing unit 11, the image forming apparatus may include, inside a housing 30, members such as a medium feeding tray (a paper feeding tray) 31, a medium feeding roller (a paper feeding roller) 32, a pair of conveying rollers 33, a transfer roller 34, a fixing unit 35, and a pair of discharging rollers 36. The medium feeding tray 31 may serve as a medium container that stores the recording medium PS.

The medium feeding tray 31 may be a member that stores the recording medium PS in a stacked fashion, and may be so provided at a lower part of the image forming apparatus as to be attachable to and detachable from the image forming apparatus.

The medium feeding roller 32 may be a member that takes the recording medium PS stored in the medium feeding tray 31 out of the medium feeding tray 31 one by one from the top, and feeds the taken out recording medium PS towards the pair of conveying rollers 33.

The pair of conveying rollers 33 may be members that correct skew of the recording medium PS fed from the medium feeding roller 32, and convey the skew-corrected recording medium PS to a transfer section in which the photosensitive drum 3 of the developing unit 11 and the transfer roller 34 are opposed to each other.

The transfer roller 34 may be a member that electrostatically transfer the toner image formed in the developing unit 11 onto a surface of the recording medium PS. The transfer roller 34 may be disposed to oppose the photosensitive drum 3 of the developing unit 11, forming the transfer section with the developing unit 11. The transfer roller 34 may be, for example but not limited to, a foamed semi-conductive elastic rubber member. Also, the transfer roller 34 may be applied with a predetermined voltage, or an applied voltage Va0, by a later-described transfer roller power supply 34V as illustrated in FIG. 5. The applied voltage Va0 may be a bias voltage having a polarity reverse to a polarity of the black toner. For example, the toner may have a negative polarity (the same applies to the following description), and the applied voltage Va0 may thus have a positive polarity. In an alternative embodiment, however, the applied voltage Va0 may be a bias voltage that has the same polarity (for example, the negative polarity) as the toner.

The fixing unit 35 may be a member that applies heat and pressure to the toner image having been transferred onto the recording medium PS to fix the toner image to the recording medium PS. The fixing unit 35 may operate based on an operation control received from a fixing control section 35S as illustrated in FIG. 5.

The pair of discharging rollers 36 may serve as a member that conveys the recording medium PS, to which the toner has been fixed by the fixing unit 35, in a direction denoted by a corresponding arrow in FIG. 4 to discharge the recording medium PS onto a discharge tray provided outside the image forming apparatus.

Further, as illustrated in FIG. 5, the image forming apparatus may include a control section 40, a reception memory 42, an image data edit memory 43, an operation section 44, a sensor group 45, and a power supply circuit 50. The control section 40 may include an interface (I/F) control section 41, a print control section 46, a head drive control section 10S, the fixing control section 35S, a conveying motor control section 37S, and a drive control section 38S. The power supply circuit 50 may include a developing roller power supply 1V, a toner feeding roller power supply 2V, a charging roller power supply 4V, a doctor blade power supply 5V, and a transfer roller power supply 34V. The image forming apparatus may further include a recording medium conveying motor 37 and a drive motor 38. The recording medium conveying motor 37 may drive the medium feeding roller 32. The drive motor 38 may drive the photosensitive drum 3.

The print control section 46 may include elements such as a microprocessor, ROM, RAM, and input and output ports, and may execute a predetermined program to control an operation of processing in the image forming apparatus as a whole, for example. More specifically, the print control section 46 may receive print data and a control command from the I/F control section 41, and perform an overall control of the head drive control section 10S, the fixing control section 35S, the conveying motor control section 37S, and the drive control section 38S to perform a printing operation.

The I/F control section 41 may receive the print data and the control command from an external device such as, but not limited to, a personal computer (PC), and may transmit a signal on a state of the image forming apparatus.

The reception memory 42 may temporarily hold the print data received through the IF control section 41 from the external device including the PC.

The image data edit memory 43 may receive the print data held in the reception memory 42 and store image data as the edited print data.

The operation section 44 may have an LED lamp for displaying, for example, the state of the image forming apparatus, and an input section including a button and a touch panel for allowing a user to give instructions to the image forming apparatus.

The sensor group 45 may include various sensors that monitor operation states of the image forming apparatus, such as a recording medium position detection sensor, a temperature-humidity sensor, a print density sensor, and a toner remaining amount detection sensor.

The head drive control section 10S may send the image data recorded in the image data edit memory 43 to the LED head 10, and perform a drive control of the LED head 10.

The fixing control section 35S may control a voltage to be applied to the fixing unit 35 when the toner image having been transferred onto the recording medium PS is to be fixed to the recording medium PS.

The conveying motor control section 37S may perform an operation control of the recording medium conveying motor 37 when the recording medium PS is to be conveyed by the medium feeding roller 32.

The drive control section 38S may perform an operation control of the drive motor 38.

The developing roller power supply 1V, the toner feeding roller power supply 2V, the charging roller power supply 4V, the doctor blade power supply 5V, and the transfer roller power supply 34V may apply their respective voltages that are based on instructions given from the print control section 46 to the developing roller 1, the toner feeding roller 2, the charging roller 4, the doctor blade 5, and the transfer roller 34, respectively. The application of the voltage to the developing roller 1 by the developing roller power supply 1V may cause the toner G supported by the developing roller 1 to be developed on the electrostatic latent image formed on the surface of the photosensitive drum 3. The application of the voltage to the toner feeding roller 2 by the toner feeding roller power supply 2V may cause the toner G to be fed from the toner feeding roller 2 to the developing roller 1. The application of the voltage to the charging roller 4 by the charging roller power supply 4V may cause the surface of the photosensitive drum 3 to be charged. The application of the voltage to the doctor blade 5 by the doctor blade power supply 5V may cause the toner layer to be formed on the surface 1S of the developing roller 1. The application of the voltage to the transfer roller 34 by the transfer roller power supply 34V may cause the toner image having been developed on the surface of the photosensitive drum 3 to be transferred onto the recording medium PS.

[Action and Effect]

[A. Basic Operation]

In the foregoing image forming apparatus, the toner image may be transferred onto the recording medium PS as follows.

When print image data and a print command are supplied from the external device including the PC to the image forming apparatus that has been started up, the print control section 46 may receive the print image data and the print command therefrom via the L/F control section 41. Upon receiving the print image data and the print command, the print control section 46 may start a printing operation of the print image data in conjunction with the drive control section 38S and any other control section, in accordance with the received print command.

The drive control section 38S may drive the drive motor 38 to rotate the photosensitive drum 3 at a constant velocity in the direction denoted by the corresponding arrow as illustrated in FIG. 1. The rotation of the photosensitive drum 3 may cause the drive force thereof to be transmitted to each of the stirring members 7A to 7C, the toner feeding roller 2, the developing roller 1, and the charging roller 4 through the drive transmission section that may include a gear train. This may result in the rotation of the stirring members 7A to 7C, the toner feeding roller 2, the developing roller 1, and the charging roller 4 in their respective directions denoted by the corresponding arrows as illustrated in FIG. 1.

Also, the print control section 46 may cause a predetermined voltage to be applied to the charging roller 4 from the charging roller power supply 4V to uniformly charge the surface of the photosensitive drum 3.

Then, the head drive control section 10S may start up the LED head 10 to cause the photosensitive drum 3 to be irradiated with light corresponding to a print image that is based on an image signal, to thereby form the electrostatic latent image on the surface of the photosensitive drum 3. Further, in the developing unit 11, the development of the toner G may be performed as follows on the electrostatic latent image formed on the surface of the photosensitive drum 3.

First, an unillustrated toner feeding shutter may be rotated to feed the toner G into the internal space 9A through the toner inlet 9K from the toner outlet 8K. Here, the drive control section 38S may drive the drive motor 38 to rotate the photosensitive drum 3. The rotation of the photosensitive drum 3 may initiate the rotation of each of the stirring members 7A to 7C, the toner feeding roller 2, the developing roller 1, and the charging roller 4. The toner G stirred sequentially by the stirring members 7A to 7C may be supported by the toner feeding roller 2 to be moved to a region near the developing roller 1 with the rotation of the toner feeding roller 2. In the region near the developing roller 1, the toner G may be negatively charged by means of a difference between a potential of the developing roller 1 and a potential of the toner feeding roller 2 to be fed to the developing roller 1. The toner G fed to the developing roller 1 may be regulated by the doctor blade 5 to form the toner layer having a predetermined thickness regulated by the doctor blade 5.

The surface of the photosensitive drum 3 may be uniformly charged by the application of the predetermined voltage to the charging roller 4 by the charging roller power supply 4V. Thereafter, the surface of the photosensitive drum 3 may be irradiated with irradiation light emitted from the LED head 10 to the surface of the photosensitive drum 3 to perform the exposure, forming the electrostatic latent image corresponding to a print pattern on the surface of the photosensitive drum 3. Further, the toner layer on the developing roller 1 may be subjected to the development based on the electrostatic latent image formed on the photosensitive drum 3 to form the toner image on the photosensitive drum 3. The toner image may be transferred onto the recording medium PS by means of an electric field between the photosensitive drum 3 and the transfer roller 34 that faces the photosensitive drum 3 and to which the predetermined voltage is applied from the transfer roller power supply 34V.

Thereafter, in the fixing unit 35, heat and pressure may be applied to the toner image transferred onto the recording medium PS to fix the toner image to the recording medium PS. The recording medium PS to which the toner image has been fixed may be discharged to the outside by the pair of discharging rollers 36. In some cases, the toner G failed to be transferred onto the recording medium PS may remain slightly on the photosensitive drum 3. Such a remaining toner G, however, may be removed by the cleaning blade 6, making it possible to use the photosensitive drum 3 continuously.

[B. Example Effects of Image Forming Apparatus]

In general, it is not easy to make an amount of toner to be fed to a developing roller and to make a charging property of the toner to be fed to the developing roller stable when a silicone rubber is used as a foamed elastic layer of a toner feeding roller. It is also not easy to keep abrasion resistance of such a foamed elastic layer high. For example, when priority is given to stability of performance, it is preferable that a hardness of the foamed elastic layer of the toner feeding roller be low and that an amount by the toner feeding roller works its way into the developing roller (i.e., a nip amount) be small in order to reduce a mechanical load applied to the toner. Employing such methods, however, involves excellent printing in the initial stage of the use of the image forming apparatus, but later results in a progress of abrasion of the foamed elastic layer attributed to the lowered hardness of the foamed elastic layer, which may in turn result in a decrease in the nip amount eventually and insufficiency of the amount of toner to be fed to the developing roller accordingly. The insufficient amount of toner to be fed to the developing roller may bring about a decrease in printing quality, including an occurrence of blurring upon solid printing and an increase in difference (i.e., a density difference) between a printing density in a region near a front end of a recording medium and a printing density in a region near a rear end of the recording medium. Making the hardness of the foamed elastic layer high to give priority to the abrasion resistance of the foamed elastic layer results in an increase in the mechanical load applied to the toner, raising concerns including an occurrence of a so-called filming and an unstable charging property of the toner. The filming is a phenomenon in which the toner is fused on a surface of the developing roller. The unstable charging property of the toner may be attributed to a promotion of releasing of an external additive in the toner, and may involve an increase in potential of a toner layer formed on the surface of the developing roller and an increase in amount of attachment of the toner on the developing roller.

In contrast, according to the example embodiment, the toner feeding roller 2 includes the elastic layer 22 having the plurality of cells 22A. The cells 22A each include the opening 22K that is exposed on the surface 2S. Further, the area occupancy rate of the openings 22K in the area of the surface 2S is in a range from 40% to 85%. This makes it possible to improve the abrasion resistance of the toner feeding roller 2 and to suppress fluctuation in potential of the toner on the developing roller 1 and fluctuation in the amount of attachment of the toner on the developing roller 1 both resulting from continuous printing over a long period of time.

[2. Examples]

In the following, some Examples of the image forming apparatus are described. It should be understood that the Examples described below are illustrative, and should not be construed as being limiting in any way.

EXPERIMENT EXAMPLE 1

As Experiment Example 1, an image forming apparatus described in the foregoing example embodiment was fabricated that had the toner feeding roller 2 having the elastic layer 22. In the Experiment Example 1, a foamed electrically-conductive silicone rubber composition of an addition reaction type was used as a rubber material that forms the elastic layer 22. The addition-reaction-type foamed electrically-conductive silicone rubber composition was prepared through sufficient kneading of: 70 pts·mass of a silicone foamed rubber composition available under the product name "KE-904FU" from Shin-Etsu Chemical Co., Ltd. located in Tokyo, Japan, 30 pts·mass of an electrical conductivity imparting agent available under the product name "KE-87C40PU" from Shin-Etsu Chemical Co., Ltd.; 2 pts·mass of an addition reaction crosslinking agent available under the product name "C-153A" from Shin-Etsu Chemical Co., Ltd.; 5 pts·mass of azobisisobutyronitrile as a foaming agent: 0.45 pts·mass of a platinum catalyst as an addition reaction catalyst: 0.5 pts·mass of a reaction control agent available under the product name "R-153A" from Shin-Etsu Chemical Co., Ltd.; and 2 pts·mass of an organic peroxide crosslinking agent available under the product name "C-3" from Shin-Etsu Chemical Co., Ltd. Note that "KE-904FU" available from Shin-Etsu Chemical Co., Ltd. contains a vinyl-group-containing silicone raw rubber and a silica-based filler but is free from containing an electrical conductivity imparting agent.

The toner feeding roller 2 was fabricated as follows. First, the cored bar 21 was cleaned using toluene, following which the cored bar 21 was coated with a primer. The cored bar 21 coated with the primer was then fired at a temperature of 150° C. followed by cooling to a room temperature to form a primer layer on the cored bar 21. Then, the addition-reaction-type foamed electrically-conductive silicone rubber composition described above was attached using an extruder around the cored bar 21 formed with the primer layer, following which heating was performed for 10 minutes at a temperature of 260° C. (primary heating) to allow for foaming and crosslinking of the composition. The thus foamed, crosslinked addition-reaction-type foamed electrically-conductive silicone rubber composition was heated for 20 minutes at a temperature of 200° C. (secondary heating), which was then left under an ordinary temperature environment. Also, the thus-formed elastic layer 22 made of the addition-reaction-type foamed electrically-conductive silicone rubber composition, having been subjected to the secondary heating, was polished until a predetermined outer diameter of the elastic layer 22 was obtained.

Figure 6:
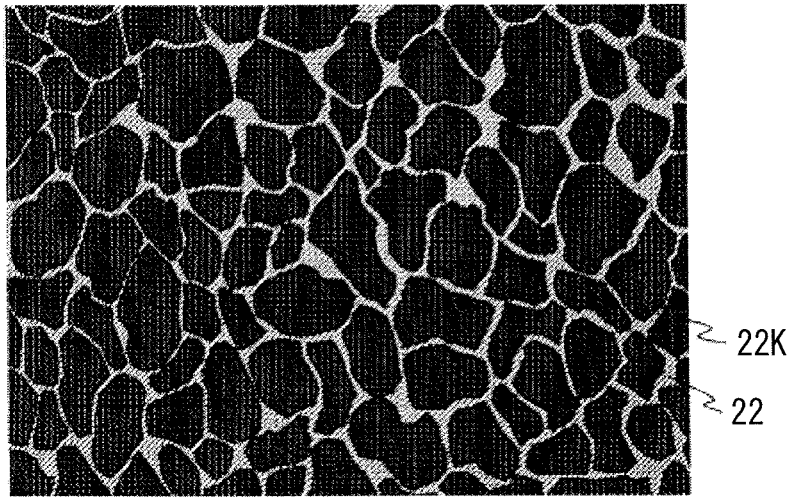
FIG. 6 is a photograph illustrating, in an enlarged manner, a surface of a toner feeding roller before being coated with a coating layer in Experiment Example 1.
Figure 7:
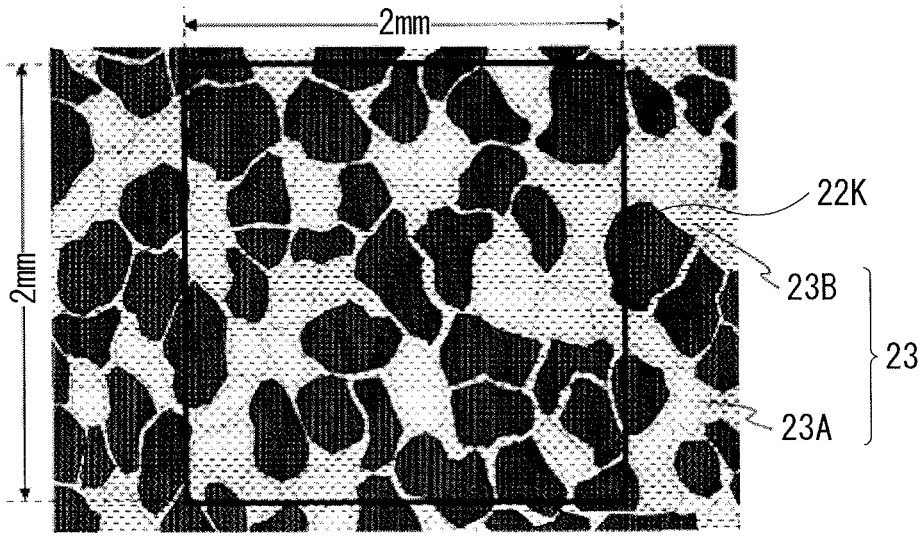
FIG. 7 is a photograph illustrating, in an enlarged manner, the surface of the toner feeding roller after being coated with the coating layer in the Experiment Example 1.

The magnified observation of the surface 22S of the elastic layer 22 on this occasion confirmed the openings 22K of the respective cells 22A and a wall (i.e., the elastic layer 22 itself) that separates the mutually-adjacent cells 22A from one another as illustrated in FIG. 6. Further, a predetermined resin composition described below was so applied using dipping as to selectively cover the surface 22S of the elastic layer 22, following which the resin composition was heated for three hours at a temperature of 150° C. to cure the resin composition and thereby to form the coating layer 23. The resin composition mentioned above was prepared through mixing of: 100 pts·mass of a methylphenyl-based silicone resin available under the product name "KR-271" from Shin-Etsu Chemical Co., Ltd.: 5 pts·mass of a carbon black as an electrical conductivity imparting agent available under the product name "ECP600JD" from Lion Corporation located in Tokyo, Japan. 1 pts·mass of a curing agent available under the product name "CAT-AC" from Shin-Etsu Chemical Co., Ltd.; and 100 pts·mass of a diluent available under the product name "KF96" from Shin-Etsu Chemical Co., Ltd. The magnified observation of the surface 2S of the thus-fabricated toner feeding roller 2 confirmed a part of the openings 22K and the coating layer 23 as illustrated in FIG. 7. It was also confirmed that the coating layer 23 was based on the continuous formation of a region 23A that fills a part of the openings 22K and a region 23B that covers the wall (i.e., the elastic layer 22 itself) that separates the mutually-adjacent cells 22A from one another. Further, the observation of any five regions, each had a size of 2 mm square, on the surface 2S of the thus-fabricated toner feeding roller 2 using a digital microscope revealed that the area occupancy rate of the openings 22K in the area of the surface 2S of the toner feeding roller 2 was 72% as an average of the five regions. Also, the elastic layer 22 respectively had the Asker F hardness and the expansion rate of 55 degrees and 350%.

Figure 8A:
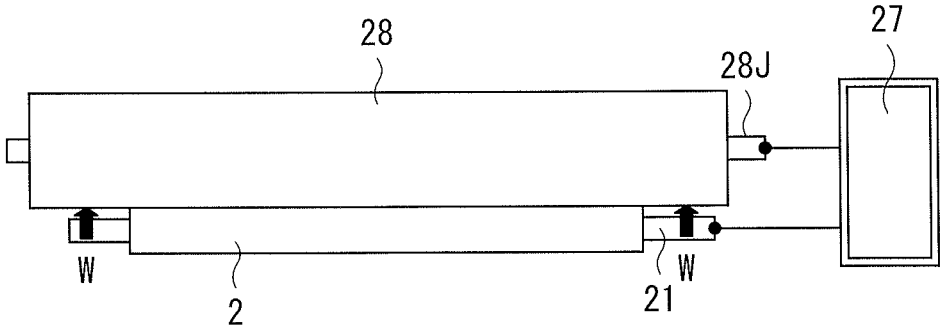
FIG. 8A is a diagram illustrating a method of measuring an electrical resistance of the toner feeding roller in the Experiment Example 1.
Figure 8B:
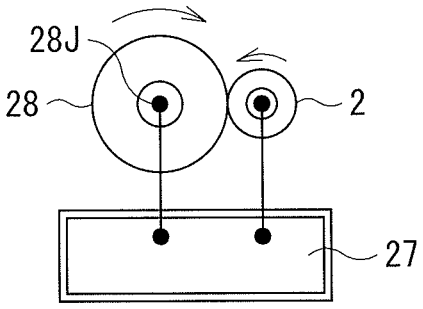
FIG. 8B is another diagram illustrating the method of measuring the electrical resistance of the toner feeding roller in the Experiment Example 1.

In this Experiment Example, an electrical resistance of the toner feeding roller 2 was set to $1\times10^6\Omega$. Referring to FIGS. 8A and 8B, the electrical resistance of the toner feeding roller 2 was measured through: bringing the toner feeding roller 2 into contact with a surface of a metal roller 28 having a rotary shaft 28J that extends in the same direction as the cored bar 21; applying a voltage of −300 V between the cored bar 21 and the rotary shaft 28J while rotating the metal roller 28 at a speed of 50 rpm; and measuring an electrical resistance upon the application of the voltage using a resistance measuring instrument 27. The resistance measuring instrument 27 used was a high resistance meter available as model number 4339B from Hewlett-Packard Company located in Palo Alto, Calif., USA. A load W of 300 g was also applied to each end of the cored bar 21. The metal roller 28 was a stainless steel having a diameter of 30 mm. The measurement was performed on 100 locations per circumference of the toner feeding roller 2 to determine an average thereof as the electrical resistance of the toner feeding roller 2.

A printing operation was executed using the image forming apparatus having the thus-fabricated toner feeding roller 2 to examine the stability of performance and the abrasion resistance of the toner feeding roller 2. In this Experiment Example, the printing operation was performed at a printing speed of 40 ppm in a vertical direction of A4-sized paper. Three thousand sheets of paper were printed per day in succession for 10 days continuously. An amount of consumption of toner per sheet was 0.3% where an amount of consumption of blank sheet and that of solid printed sheet were respectively defined as 0% and 100%. Such a printing operation was performed under an environment of 50% relative humidity at a temperature of 20° C.

Also, the developing roller 1 had an outer diameter of 16 mm, the toner feeding roller 2 had an outer diameter of 15.5 mm, the elastic layer 22 had a thickness of 4.25 mm, and the nip amount by which the toner feeding roller 2 works its way into the developing roller 1 was 1.0 mm. The nip amount was defined as a length determined by subtracting the distance from the sum of the radius of the developing roller 1 and the radius of the toner feeding member 2. The distance was from the center of rotation of the developing roller 1 to the center of rotation of the toner feeding roller 2. A circumferential velocity of the developing roller 1 and that of the toner feeding roller 2 were respectively set to 0.3 m/s and 0.2 m/s. A direct-current voltage of −200 V was applied to the developing roller 1, whereas a direct-current voltage of −330 V was applied to the toner feeding roller 2.

The developing roller 1 had a surface roughness in a direction of rotation in a range from 2 μm to 10 μm in Rz value according to JIS B0601-1994 standard. The measurement of the Rz value for the surface roughness was performed using the surface roughness measuring instrument "surfcorder SEF3500" available from Kosaka Laboratory Ltd. located in Tokyo, Japan, where measurement conditions included a stylus radius of 2 μm, a stylus pressure of 0.7 mN, a stylus feeding speed of 0.1 mmisec, and a measurement length of 2.5 mm.

A direct-current voltage of −300 V was applied to the doctor blade 5. The doctor blade 5 was made of a 0.08 mm thick stainless steel, and had been subjected to bending to allow a region that comes into contact with the developing roller 1 to have a curved surface having a curvature radius of 0.18 mm. A linear pressure applied to the developing roller 1 by the doctor blade 5 was set to 40 gf/cm.

EXPERIMENT EXAMPLE 2

An image forming apparatus having the toner feeding roller 2 was fabricated to perform the printing operation. The image forming apparatus was fabricated similarly to the Experiment Example 1 with the exception that the nip amount by which the toner feeding roller 2 works its way into the developing roller 1 was set to 0.6 mm.

EXPERIMENT EXAMPLE 3

An image forming apparatus having the toner feeding roller 2 was fabricated to perform the printing operation. The image forming apparatus was fabricated similarly to the Experiment Example 1 with the exception that the nip amount by which the toner feeding roller 2 works its way into the developing roller 1 was set to 1.3 mm.

EXPERIMENT EXAMPLE 4

An image forming apparatus having the toner feeding roller 2 was fabricated to perform the printing operation. The image forming apparatus was fabricated similarly to the Experiment Example 1 with the exception that an additive amount of the platinum catalyst as the addition reaction catalyst was changed, and that the Asker F hardness and the expansion rate of the elastic layer 22 were respectively set to 63 degrees and 310%.

EXPERIMENT EXAMPLE 5

An image forming apparatus having the toner feeding roller 2 was fabricated to perform the printing operation. The image forming apparatus was fabricated similarly to the Experiment Example 1 with the exception that an additive amount of the platinum catalyst as the addition reaction catalyst was changed, and that the Asker F hardness and the expansion rate of the elastic layer 22 were respectively set to 48 degrees and 410%.

EXPERIMENT EXAMPLE 6

An image forming apparatus having the toner feeding roller 2 was fabricated to perform the printing operation. The image forming apparatus was fabricated similarly to the Experiment Example 4 with the exception that the nip amount by which the toner feeding roller 2 works its way into the developing roller 1 was set to 0.6 mm.

EXPERIMENT EXAMPLE 7

An image forming apparatus having the toner feeding roller 2 was fabricated to perform the printing operation. The image forming apparatus was fabricated similarly to the Experiment Example 4 with the exception that the nip amount by which the toner feeding roller 2 works its way into the developing roller 1 was set to 1.3 mm.

EXPERIMENT EXAMPLE 8

An image forming apparatus having the toner feeding roller 2 was fabricated to perform the printing operation. The image forming apparatus was fabricated similarly to the Experiment Example 5 with the exception that the nip amount by which the toner feeding roller 2 works its way into the developing roller 1 was set to 0.6 mm.

EXPERIMENT EXAMPLE 9

An image forming apparatus having the toner feeding roller 2 was fabricated to perform the printing operation. The image forming apparatus was fabricated similarly to the Experiment Example 5 with the exception that the nip amount by which the toner feeding roller 2 works its way into the developing roller 1 was set to 1.3 mm.

EXPERIMENT EXAMPLE 10

An image forming apparatus having the toner feeding roller 2 was fabricated to perform the printing operation. The image forming apparatus was fabricated similarly to the Experiment Example 1 with the exception that: the diluent "KF96" available from Shin-Etsu Chemical Co., Ltd. was increased to 200 pts·mass to form the coating layer 23; the area occupancy rate of the openings 22K in the area of the surface 2S of the toner feeding roller 2 was set to 85% as an average of the five regions; and the Asker F hardness and the expansion rate of the elastic layer 22 were respectively set to 54 degrees and 355%.

EXPERIMENT EXAMPLE 11

An image forming apparatus having the toner feeding roller 2 was fabricated to perform the printing operation. The image forming apparatus was fabricated similarly to the Experiment Example 10 with the exception that the nip amount by which the toner feeding roller 2 works its way into the developing roller 1 was set to 0.6 mm.

EXPERIMENT EXAMPLE 12

An image forming apparatus having the toner feeding roller 2 was fabricated to perform the printing operation. The image forming apparatus was fabricated similarly to the Experiment Example 10 with the exception that the nip amount by which the toner feeding roller 2 works its way into the developing roller 1 was set to 1.3 mm.

EXPERIMENT EXAMPLE 13

An image forming apparatus having the toner feeding roller 2 was fabricated to perform the printing operation. The image forming apparatus was fabricated similarly to the Experiment Example 10 with the exception that an additive amount of the platinum catalyst as the addition reaction catalyst was changed, and that the Asker F hardness and the expansion rate of the elastic layer 22 were respectively set to 63 degrees and 310%.

EXPERIMENT EXAMPLE 14

An image forming apparatus having the toner feeding roller 2 was fabricated to perform the printing operation. The image forming apparatus was fabricated similarly to the Experiment Example 10 with the exception that an additive amount of the platinum catalyst as the addition reaction catalyst was changed, and that the Asker F hardness and the expansion rate of the elastic layer 22 were respectively set to 48 degrees and 410%.

EXPERIMENT EXAMPLE 15

An image forming apparatus having the toner feeding roller 2 was fabricated to perform the printing operation. The image forming apparatus was fabricated similarly to the Experiment Example 13 with the exception that the nip amount by which the toner feeding roller 2 works its way into the developing roller 1 was set to 0.6 mm.

EXPERIMENT EXAMPLE 16

An image forming apparatus having the toner feeding roller 2 was fabricated to perform the printing operation. The image forming apparatus was fabricated similarly to the Experiment Example 13 with the exception that the nip amount by which the toner feeding roller 2 works its way into the developing roller 1 was set to 1.3 mm.

EXPERIMENT EXAMPLE 17

An image forming apparatus having the toner feeding roller 2 was fabricated to perform the printing operation. The image forming apparatus was fabricated similarly to the Experiment Example 14 with the exception that the nip amount by which the toner feeding roller 2 works its way into the developing roller 1 was set to 0.6 mm.

EXPERIMENT EXAMPLE 18

An image forming apparatus having the toner feeding roller 2 was fabricated to perform the printing operation. The image forming apparatus was fabricated similarly to the Experiment Example 14 with the exception that the nip amount by which the toner feeding roller 2 works its way into the developing roller 1 was set to 1.3 mm.

EXPERIMENT EXAMPLE 19

An image forming apparatus having the toner feeding roller 2 was fabricated to perform the printing operation. The image forming apparatus was fabricated similarly to the Experiment Example 1 with the exception that: the diluent "KF96" available from Shin-Etsu Chemical Co., Ltd. was decreased to 75 pts·mass to form the coating layer 23; the area occupancy rate of the openings 22K in the area of the surface 2S of the toner feeding roller 2 was set to 54% as an average of the five regions; and the Asker F hardness and the expansion rate of the elastic layer 22 were respectively set to 56 degrees and 355%.

EXPERIMENT EXAMPLE 20

An image forming apparatus having the toner feeding roller 2 was fabricated to perform the printing operation. The image forming apparatus was fabricated similarly to the Experiment Example 19 with the exception that the nip amount by which the toner feeding roller 2 works its way into the developing roller 1 was set to 0.6 mm.

EXPERIMENT EXAMPLE 21

An image forming apparatus having the toner feeding roller 2 was fabricated to perform the printing operation. The image forming apparatus was fabricated similarly to the Experiment Example 19 with the exception that the nip amount by which the toner feeding roller 2 works its way into the developing roller 1 was set to 1.3 mm.

EXPERIMENT EXAMPLE 22

An image forming apparatus having the toner feeding roller 2 was fabricated to perform the printing operation. The image forming apparatus was fabricated similarly to the Experiment Example 19 with the exception that an additive amount of the platinum catalyst as the addition reaction catalyst was changed, and that the Asker F hardness and the expansion rate of the elastic layer 22 were respectively set to 63 degrees and 310%.

EXPERIMENT EXAMPLE 23

An image forming apparatus having the toner feeding roller 2 was fabricated to perform the printing operation. The image forming apparatus was fabricated similarly to the Experiment Example 19 with the exception that an additive amount of the platinum catalyst as the addition reaction catalyst was changed, and that the Asker F hardness and the expansion rate of the elastic layer 22 were respectively set to 48 degrees and 410%.

EXPERIMENT EXAMPLE 24

An image forming apparatus having the toner feeding roller 2 was fabricated to perform the printing operation. The image forming apparatus was fabricated similarly to the Experiment Example 22 with the exception that the nip amount by which the toner feeding roller 2 works its way into the developing roller 1 was set to 0.6 mm.

EXPERIMENT EXAMPLE 25

An image forming apparatus having the toner feeding roller 2 was fabricated to perform the printing operation. The image forming apparatus was fabricated similarly to the Experiment Example 22 with the exception that the nip amount by which the toner feeding roller 2 works its way into the developing roller 1 was set to 1.3 mm.

EXPERIMENT EXAMPLE 26

An image forming apparatus having the toner feeding roller 2 was fabricated to perform the printing operation. The image forming apparatus was fabricated similarly to the Experiment Example 23 with the exception that the nip amount by which the toner feeding roller 2 works its way into the developing roller 1 was set to 0.6 mm.

EXPERIMENT EXAMPLE 27

An image forming apparatus having the toner feeding roller 2 was fabricated to perform the printing operation. The image forming apparatus was fabricated similarly to the Experiment Example 23 with the exception that the nip amount by which the toner feeding roller 2 works its way into the developing roller 1 was set to 1.3 mm.

EXPERIMENT EXAMPLE 28

An image forming apparatus having the toner feeding roller 2 was fabricated to perform the printing operation. The image forming apparatus was fabricated similarly to the Experiment Example 1 with the exception that: the diluent "KF96" available from Shin-Etsu Chemical Co., Ltd. was decreased to 60 pts·mass to form the coating layer 23; the area occupancy rate of the openings 22K in the area of the surface 2S of the toner feeding roller 2 was set to 40% as an average of the five regions; and the Asker F hardness and the expansion rate of the elastic layer 22 were respectively set to 57 degrees and 340%.

EXPERIMENT EXAMPLE 29

An image forming apparatus having the toner feeding roller 2 was fabricated to perform the printing operation. The image forming apparatus was fabricated similarly to the Experiment Example 28 with the exception that the nip amount by which the toner feeding roller 2 works its way into the developing roller 1 was set to 0.6 mm.

EXPERIMENT EXAMPLE 30

An image forming apparatus having the toner feeding roller 2 was fabricated to perform the printing operation. The image forming apparatus was fabricated similarly to the Experiment Example 28 with the exception that the nip amount by which the toner feeding roller 2 works its way into the developing roller 1 was set to 1.3 mm.

EXPERIMENT EXAMPLE 31

An image forming apparatus having the toner feeding roller 2 was fabricated to perform the printing operation. The image forming apparatus was fabricated similarly to the Experiment Example 28 with the exception that an additive amount of the platinum catalyst as the addition reaction catalyst was changed, and that the Asker F hardness and the expansion rate of the elastic layer 22 were respectively set to 63 degrees and 310%.

EXPERIMENT EXAMPLE 32

An image forming apparatus having the toner feeding roller 2 was fabricated to perform the printing operation. The image forming apparatus was fabricated similarly to the Experiment Example 28 with the exception that an additive amount of the platinum catalyst as the addition reaction catalyst was changed, and that the Asker F hardness and the expansion rate of the elastic layer 22 were respectively set to 48 degrees and 410%.

EXPERIMENT EXAMPLE 33

An image forming apparatus having the toner feeding roller 2 was fabricated to perform the printing operation. The image forming apparatus was fabricated similarly to the Experiment Example 31 with the exception that the nip amount by which the toner feeding roller 2 works its way into the developing roller 1 was set to 0.6 mm.

EXPERIMENT EXAMPLE 34

An image forming apparatus having the toner feeding roller 2 was fabricated to perform the printing operation. The image forming apparatus was fabricated similarly to the Experiment Example 31 with the exception that the nip amount by which the toner feeding roller 2 works its way into the developing roller 1 was set to 1.3 mm.

EXPERIMENT EXAMPLE 35

An image forming apparatus having the toner feeding roller 2 was fabricated to perform the printing operation. The image forming apparatus was fabricated similarly to the Experiment Example 32 with the exception that the nip amount by which the toner feeding roller 2 works its way into the developing roller 1 was set to 0.6 mm.

EXPERIMENT EXAMPLE 36

An image forming apparatus having the toner feeding roller 2 was fabricated to perform the printing operation. The image forming apparatus was fabricated similarly to the Experiment Example 32 with the exception that the nip amount by which the toner feeding roller 2 works its way into the developing roller 1 was set to 1.3 mm.

EXPERIMENT EXAMPLE 37

An image forming apparatus having the toner feeding roller 2 was fabricated to perform the printing operation. The image forming apparatus was fabricated similarly to the Experiment Example 1 with the exception that: the formation of the coating layer 23 was omitted; the area occupancy rate of the openings 22K in the area of the surface 2S of the toner feeding roller 2 was set to 94% as an average of the five regions; and the Asker F hardness and the expansion rate of the elastic layer 22 were respectively set to 55 degrees and 330%.

EXPERIMENT EXAMPLE 38

An image forming apparatus having the toner feeding roller 2 was fabricated to perform the printing operation. The image forming apparatus was fabricated similarly to the Experiment Example 1 with the exception that: the diluent "KF96" available from Shin-Etsu Chemical Co., Ltd. was increased to 250 pts·mass to form the coating layer 23; the area occupancy rate of the openings 22K in the area of the surface 2S of the toner feeding roller 2 was set to 88% as an average of the five regions; and the Asker F hardness and the expansion rate of the elastic layer 22 were respectively set to 54 degrees and 330%.

EXPERIMENT EXAMPLE 39

An image forming apparatus having the toner feeding roller 2 was fabricated to perform the printing operation. The image forming apparatus was fabricated similarly to the Experiment Example 38 with the exception that the nip amount by which the toner feeding roller 2 works its way into the developing roller 1 was set to 0.6 mm.

EXPERIMENT EXAMPLE 40

An image forming apparatus having the toner feeding roller 2 was fabricated to perform the printing operation. The image forming apparatus was fabricated similarly to the Experiment Example 38 with the exception that the nip amount by which the toner feeding roller 2 works its way into the developing roller 1 was set to 1.3 mm.

EXPERIMENT EXAMPLE 41

An image forming apparatus having the toner feeding roller 2 was fabricated to perform the printing operation. The image forming apparatus was fabricated similarly to the Experiment Example 38 with the exception that an additive amount of the platinum catalyst as the addition reaction catalyst was changed, and that the Asker F hardness and the expansion rate of the elastic layer 22 were respectively set to 63 degrees and 310%.

EXPERIMENT EXAMPLE 42

An image forming apparatus having the toner feeding roller 2 was fabricated to perform the printing operation. The image forming apparatus was fabricated similarly to the Experiment Example 38 with the exception that an additive amount of the platinum catalyst as the addition reaction catalyst was changed, and that the Asker F hardness and the expansion rate of the elastic layer 22 were respectively set to 48 degrees and 410%.

EXPERIMENT EXAMPLE 43

An image forming apparatus having the toner feeding roller 2 was fabricated to perform the printing operation. The image forming apparatus was fabricated similarly to the Experiment Example 41 with the exception that the nip amount by which the toner feeding roller 2 works its way into the developing roller 1 was set to 0.6 mm.

EXPERIMENT EXAMPLE 44

An image forming apparatus having the toner feeding roller 2 was fabricated to perform the printing operation. The image forming apparatus was fabricated similarly to the Experiment Example 41 with the exception that the nip amount by which the toner feeding roller 2 works its way into the developing roller 1 was set to 1.3 mm.

EXPERIMENT EXAMPLE 45

An image forming apparatus having the toner feeding roller 2 was fabricated to perform the printing operation. The image forming apparatus was fabricated similarly to the Experiment Example 42 with the exception that the nip amount by which the toner feeding roller 2 works its way into the developing roller 1 was set to 0.6 mm.

EXPERIMENT EXAMPLE 46

An image forming apparatus having the toner feeding roller 2 was fabricated to perform the printing operation. The image forming apparatus was fabricated similarly to the Experiment Example 42 with the exception that the nip amount by which the toner feeding roller 2 works its way into the developing roller 1 was set to 1.3 mm.

EXPERIMENT EXAMPLE 47

An image forming apparatus having the toner feeding roller 2 was fabricated to perform the printing operation. The image forming apparatus was fabricated similarly to the Experiment Example 1 with the exception that: the diluent "KF96" available from Shin-Etsu Chemical Co., Ltd. was decreased to 45 pts·mass to form the coating layer 23; the area occupancy rate of the openings 22K in the area of the surface 2S of the toner feeding roller 2 was set to 35% as an average of the five regions; and the Asker F hardness and the expansion rate of the elastic layer 22 were respectively set to 57 degrees and 330%.

EXPERIMENT EXAMPLE 48

An image forming apparatus having the toner feeding roller 2 was fabricated to perform the printing operation. The image forming apparatus was fabricated similarly to the Experiment Example 47 with the exception that the nip amount by which the toner feeding roller 2 works its way into the developing roller 1 was set to 0.6 mm.

EXPERIMENT EXAMPLE 49

An image forming apparatus having the toner feeding roller 2 was fabricated to perform the printing operation. The image forming apparatus was fabricated similarly to the Experiment Example 47 with the exception that the nip amount by which the toner feeding roller 2 works its way into the developing roller 1 was set to 1.3 mm.

EXPERIMENT EXAMPLE 50

An image forming apparatus having the toner feeding roller 2 was fabricated to perform the printing operation. The image forming apparatus was fabricated similarly to the Experiment Example 47 with the exception that an additive amount of the platinum catalyst as the addition reaction catalyst was changed, and that the Asker F hardness and the expansion rate of the elastic layer 22 were respectively set to 63 degrees and 310%.

EXPERIMENT EXAMPLE 51

An image forming apparatus having the toner feeding roller 2 was fabricated to perform the printing operation. The image forming apparatus was fabricated similarly to the Experiment Example 47 with the exception that an additive amount of the platinum catalyst as the addition reaction catalyst was changed, and that the Asker F hardness and the expansion rate of the elastic layer 22 were respectively set to 48 degrees and 410%.

EXPERIMENT EXAMPLE 52

An image forming apparatus having the toner feeding roller 2 was fabricated to perform the printing operation. The image forming apparatus was fabricated similarly to the Experiment Example 50 with the exception that the nip amount by which the toner feeding roller 2 works its way into the developing roller 1 was set to 0.6 mm.

EXPERIMENT EXAMPLE 53

An image forming apparatus having the toner feeding roller 2 was fabricated to perform the printing operation. The image forming apparatus was fabricated similarly to the Experiment Example 50 with the exception that the nip amount by which the toner feeding roller 2 works its way into the developing roller 1 was set to 1.3 mm.

EXPERIMENT EXAMPLE 54

An image forming apparatus having the toner feeding roller 2 was fabricated to perform the printing operation. The image forming apparatus was fabricated similarly to the Experiment Example 51 with the exception that the nip amount by which the toner feeding roller 2 works its way into the developing roller 1 was set to 0.6 mm.

EXPERIMENT EXAMPLE 55

An image forming apparatus having the toner feeding roller 2 was fabricated to perform the printing operation. The image forming apparatus was fabricated similarly to the Experiment Example 51 with the exception that the nip amount by which the toner feeding roller 2 works its way into the developing roller 1 was set to 1.3 mm.

EXPERIMENT EXAMPLE 56

An image forming apparatus having the toner feeding roller 2 was fabricated to perform the printing operation. The image forming apparatus was fabricated similarly to the Experiment Example 1 with the exception that the nip amount by which the toner feeding roller 2 works its way into the developing roller 1 was set to 0.5 mm, and that the expansion rate of the elastic layer 22 was set to 330%.

EXPERIMENT EXAMPLE 57

An image forming apparatus having the toner feeding roller 2 was fabricated to perform the printing operation. The image forming apparatus was fabricated similarly to the Experiment Example 1 with the exception that the nip amount by which the toner feeding roller 2 works its way into the developing roller 1 was set to 1.4 mm, and that the expansion rate of the elastic layer 22 was set to 330%.

EXPERIMENT EXAMPLE 58

An image forming apparatus having the toner feeding roller 2 was fabricated to perform the printing operation. The image forming apparatus was fabricated similarly to the Experiment Example 1 with the exception that an additive amount of the platinum catalyst as the addition reaction catalyst was changed, and that the Asker F hardness and the expansion rate of the elastic layer 22 were respectively set to 65 degrees and 310%.

EXPERIMENT EXAMPLE 59

An image forming apparatus having the toner feeding roller 2 was fabricated to perform the printing operation. The image forming apparatus was fabricated similarly to the Experiment Example 1 with the exception that an additive amount of the platinum catalyst as the addition reaction catalyst was changed, and that the Asker F hardness and the expansion rate of the elastic layer 22 were respectively set to 45 degrees and 440%.

EXPERIMENT EXAMPLE 60

An image forming apparatus having the toner feeding roller 2 was fabricated to perform the printing operation. The image forming apparatus was fabricated similarly to the Experiment Example 1 with the exception that: the formation of the coating layer 23 was omitted; the area occupancy rate of the openings 22K in the area of the surface 2S of the toner feeding roller 2 was set to 45% as an average of the five regions; and the Asker F hardness and the expansion rate of the elastic layer 22 were respectively set to 63 degrees and 290%.

EXPERIMENT EXAMPLE 61

An image forming apparatus having the toner feeding roller 2 was fabricated to perform the printing operation. The image forming apparatus was fabricated similarly to the Experiment Example 1 with the exception that: the formation of the coating layer 23 was omitted; the area occupancy rate of the openings 22K in the area of the surface 2S of the toner feeding roller 2 was set to 83% as an average of the five regions; and the Asker F hardness and the expansion rate of the elastic layer 22 were respectively set to 49 degrees and 455%.

An evaluation was performed, in terms of (1) to (5) described below, on the stability of performance and the abrasion resistance of each of the toner feeding rollers 2 according to the respective Experiment Examples that were based on the printing operation performed under the conditions described above.

(1) An amount of abrasion of the toner feeding roller 2 after printing of 30,000 pieces of paper.

Here, it is desirable that a reduction in an outer diameter of the toner feeding roller 2 be 0.2 mm or less, because an amount of toner to be fed to the developing roller 1 decreases with the reduction in the outer diameter of the toner feeding roller 2 resulting from the abrasion.

(2) An increase in toner potential at the surface 1S of the developing roller 1 after printing of 3,000 pieces of paper, with respect to the toner potential at the surface 1S of the developing roller 1 before the printing of 3,000 pieces of paper.

Here, it is desirable that an average of the increase in toner potential for each day be 10 V or less, because exceeding 10 V leads to an easier occurrence of the smear. In this evaluation, the measurement was performed on the toner at the point A illustrated in FIG. 1.

(3) An increase in attachment of the toner on the surface 1S of the developing roller 1 after the printing of 3,000 pieces of paper, with respect to an increase in attachment of the toner on the surface 1S of the developing roller 1 before the printing of 3,000 pieces of paper.

Here, it is desirable that an average of the attachment of the toner for each day be 0.05 mg/cm$^2$ or less, because exceeding 0.05 mg/cm$^2$ leads to an easier occurrence of the smear. In this evaluation, the measurement was performed on the toner at the point A illustrated in FIG. 1.

(4) A difference in printing density between before and after the printing of 3,000 pieces of paper for each day.

Figure 9:
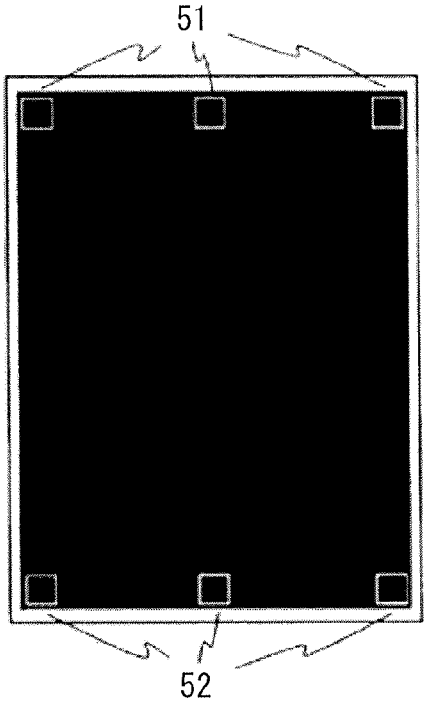
FIG. 9 describes a difference in printing density obtained in each of Experiment Examples 1 to 61.

Referring to FIG. 9, the solid printing was performed on the pieces of paper each conveyed in an arrow direction (conveyed upward). Then, the printing density in three regions 51 located near the front end of each of the pieces of paper was measured to obtain an average of the printing density in those front end regions 51. The printing density in three regions 52 located near the rear end of each of the pieces of paper was also measured to obtain an average of the printing density in those rear end regions 52. A difference in average therebetween was determined as the printing density difference, i.e., the average of the printing density in the front end regions 51 minus (−) the average of the printing density in the rear end regions 52. The measurement was performed using a spectrodensitometer available under the product name "X-Rite528" from X-Rite located in Grand Rapids, Mich., USA. Here, it is desirable that the printing density difference be 0.10 or less, because the printing density difference of 0.10 or less makes an afterimage attributed to a feeding property of the toner less noticeable and thereby makes it possible to determine that the feeding of the toner performed by the toner feeding roller 2 to the developing roller 1 is appropriate.

(5) Presence of Smear Upon Halftone Pattern Printing Before and after the Printing of 3,000 Pieces of Paper for Each Day.

Figure 10:
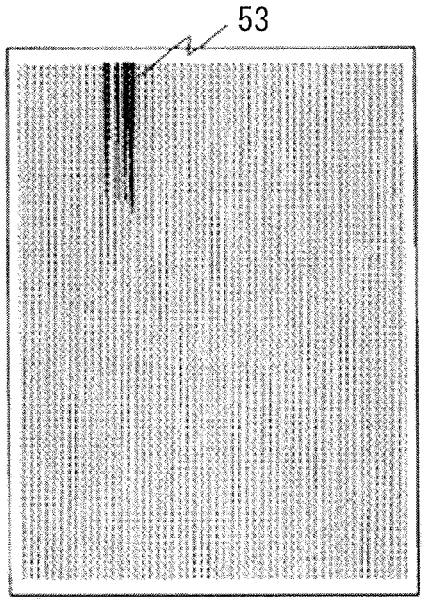
FIG. 10 describes about a smear.

Here, it is desirable that a smear be prevented from occurring without a single occurrence in halftone pattern printing. The "smear" referred to here includes a smear 53 illustrated by way of example in FIG. 10, which may be attributed to a phenomenon in which the toner G is developed at a non-development region of the photosensitive drum 3 by an increase in the toner potential on the developing roller 1 and an increase in the attachment of the toner on the developing roller 1.

Performing the halftone pattern printing allows for a regular arrangement of a development region and the non-development region on an electrostatic latent image formed on the photosensitive drum 3, making it easier to cause the toner G at a high potential to be developed on the photosensitive drum 3 at a boundary between the development region and the non-development region. This in turn makes it possible to detect the smear occurring in the halftone pattern printing at sensitivity higher than sensitivity of detection performed on scumming occurring at a white background.

All of the toner feeding rollers 2 evaluated as "good" on the basis of the evaluation performed in terms of (1) to (5) described above were each determined as the toner feeding roller 2 having excellent stability of performance and abrasion resistance over a long period of time. The following Tables 1 to 7 show results of the evaluation.

TABLE 1

| Table 1 | Experiment Example 1 | Experiment Example 2 | Experiment Example 3 | Experiment Example 4 | Experiment Example 5 |
|---|---|---|---|---|---|
| Presence of Coating Layer | Yes | Yes | Yes | Yes | Yes |
| Opening Occupancy Area Rate [%] | 72 | 72 | 72 | 72 | 72 |
| Asker F Hardness [degree] | 55 | 55 | 55 | 63 | 48 |
| Expansion Rate [%] | 350 | 350 | 350 | 310 | 410 |
| Nip Amount [mm] | 1.0 | 0.6 | 1.3 | 1.0 | 1.0 |
| Abrasion of Toner Feeding Roller [mm] | 0.16 | 0.13 | 0.18 | 0.17 | 0.14 |
| Increase in Toner Layer Potential [V] | 6 | 8 | 4 | 5 | 7 |
| Increase in Toner Attachment [mg/cm$^2$] | 0.03 | 0.04 | 0.03 | 0.02 | 0.03 |
| Printing Density Difference [O.D.] | 0.06 | 0.08 | 0.06 | 0.07 | 0.09 |
| Presence of Smear in Halftone Printing | No | No | No | No | No |

| Table 1 | Experiment Example 6 | Experiment Example 7 | Experiment Example 8 | Experiment Example 9 |
|---|---|---|---|---|
| Presence of Coating Layer | Yes | Yes | Yes | Yes |
| Opening Occupancy Area Rate [%] | 72 | 72 | 72 | 72 |
| Asker F Hardness [degree] | 63 | 63 | 48 | 48 |
| Expansion Rate [%] | 310 | 310 | 410 | 410 |
| Nip Amount [mm] | 0.6 | 1.3 | 0.6 | 1.3 |
| Abrasion of Toner Feeding Roller [mm] | 0.14 | 0.19 | 0.11 | 0.14 |
| Increase in Toner Layer Potential [V] | 6 | 3 | 9 | 4 |
| Increase in Toner Attachment [mg/cm$^2$] | 0.03 | 0.02 | 0.05 | 0.04 |
| Printing Density Difference [O.D.] | 0.07 | 0.06 | 0.09 | 0.07 |
| Existence of Smear in Halftone Printing | No | No | No | No |

TABLE 2

| Table 2 | Experiment Example 10 | Experiment Example 11 | Experiment Example 12 | Experiment Example 13 | Experiment Example 14 |
|---|---|---|---|---|---|
| Presence of Coating Layer | Yes | Yes | Yes | Yes | Yes |
| Opening Occupancy Area Rate [%] | 85 | 85 | 85 | 85 | 85 |
| Asker F Hardness [degree] | 54 | 54 | 54 | 63 | 48 |
| Expansion Rate [%] | 355 | 355 | 355 | 310 | 410 |
| Nip Amount [mm] | 1.0 | 0.6 | 1.3 | 1.0 | 1.0 |
| Abrasion of Toner Feeding Roller [mm] | 0.18 | 0.14 | 0.19 | 0.17 | 0.15 |
| Increase in Toner Layer Potential [V] | 8 | 9 | 4 | 7 | 9 |
| Increase in Toner Attachment [mg/cm$^2$] | 0.04 | 0.04 | 0.03 | 0.03 | 0.05 |
| Printing Density Difference [O.D.] | 0.07 | 0.08 | 0.06 | 0.06 | 0.05 |
| Presence of Smear in Halftone Printing | No | No | No | No | No |

TABLE 2-continued

| Table 2 | Experiment Example 15 | Experiment Example 16 | Experiment Example 17 | Experiment Example 18 |
|---|---|---|---|---|
| Presence of Coating Layer | Yes | Yes | Yes | Yes |
| Opening Occupancy Area Rate [%] | 85 | 85 | 85 | 85 |
| Asker F Hardness [degree] | 63 | 63 | 48 | 48 |
| Expansion Rate [%] | 310 | 310 | 410 | 410 |
| Nip Amount [mm] | 0.6 | 1.3 | 0.6 | 1.3 |
| Abrasion of Toner Feeding Roller [mm] | 0.16 | 0.20 | 0.13 | 0.16 |
| Increase in Toner Layer Potential [V] | 7 | 5 | 10 | 6 |
| Increase in Toner Attachment [mg/cm$^2$] | 0.03 | 0.03 | 0.05 | 0.03 |
| Printing Density Difference [O.D.] | 0.07 | 0.05 | 0.10 | 0.08 |
| Existence of Smear in Halftone Printing | No | No | No | No |

TABLE 3

| Table 3 | Experiment Example 19 | Experiment Example 20 | Experiment Example 21 | Experiment Example 22 | Experiment Example 23 |
|---|---|---|---|---|---|
| Presence of Coating Layer | Yes | Yes | Yes | Yes | Yes |
| Opening Occupancy Area Rate [%] | 54 | 54 | 54 | 54 | 54 |
| Asker F Hardness [degree] | 56 | 56 | 56 | 63 | 48 |
| Expansion Rate [%] | 355 | 355 | 355 | 310 | 410 |
| Nip Amount [mm] | 1.0 | 0.6 | 1.3 | 1.0 | 1.0 |
| Abrasion of Toner Feeding Roller [mm] | 0.14 | 0.12 | 0.17 | 0.12 | 0.12 |
| Increase in Toner Layer Potential [V] | 5 | 7 | 4 | 4 | 6 |
| Increase in Toner Attachment [mg/cm$^2$] | 0.03 | 0.03 | 0.02 | 0.02 | 0.03 |
| Printing Density Difference [O.D.] | 0.06 | 0.08 | 0.06 | 0.05 | 0.07 |
| Presence of Smear in Halftone Printing | No | No | No | No | No |

| Table 3 | Experiment Example 24 | Experiment Example 25 | Experiment Example 26 | Experiment Example 27 |
|---|---|---|---|---|
| Presence of Coating Layer | Yes | Yes | Yes | Yes |
| Opening Occupancy Area Rate [%] | 54 | 54 | 54 | 54 |
| Asker F Hardness [degree] | 63 | 63 | 48 | 48 |
| Expansion Rate [%] | 310 | 310 | 410 | 410 |
| Nip Amount [mm] | 0.6 | 1.3 | 0.6 | 1.3 |
| Abrasion of Toner Feeding Roller [mm] | 0.13 | 0.16 | 0.11 | 0.13 |
| Increase in Toner Layer Potential [V] | 5 | 2 | 6 | 3 |
| Increase in Toner Attachment [mg/cm$^2$] | 0.04 | 0.02 | 0.05 | 0.03 |
| Printing Density Difference [O.D.] | 0.07 | 0.06 | 0.09 | 0.07 |
| Existence of Smear in Halftone Printing | No | No | No | No |

TABLE 4

| Table 4 | Experiment Example 28 | Experiment Example 29 | Experiment Example 30 | Experiment Example 31 | Experiment Example 32 |
|---|---|---|---|---|---|
| Presence of Coating Layer | Yes | Yes | Yes | Yes | Yes |
| Opening Occupancy Area Rate [%] | 40 | 40 | 40 | 40 | 40 |
| Asker F Hardness [degree] | 57 | 57 | 57 | 63 | 48 |
| Expansion Rate [%] | 340 | 340 | 340 | 310 | 410 |
| Nip Amount [mm] | 1.0 | 0.6 | 1.3 | 1.0 | 1.0 |
| Abrasion of Toner Feeding Roller [mm] | 0.13 | 0.09 | 0.15 | 0.13 | 0.10 |
| Increase in Toner Layer Potential [V] | 3 | 6 | 2 | 4 | 4 |
| Increase in Toner Attachment [mg/cm$^2$] | 0.02 | 0.03 | 0.01 | 0.02 | 0.03 |
| Printing Density Difference [O.D.] | 0.07 | 0.08 | 0.08 | 0.06 | 0.08 |
| Presence of Smear in Halftone Printing | No | No | No | No | No |

| Table 4 | Experiment Example 33 | Experiment Example 34 | Experiment Example 35 | Experiment Example 36 |
|---|---|---|---|---|
| Presence of Coating Layer | Yes | Yes | Yes | Yes |
| Opening Occupancy Area Rate [%] | 40 | 40 | 40 | 40 |
| Asker F Hardness [degree] | 63 | 63 | 48 | 48 |
| Expansion Rate [%] | 310 | 310 | 410 | 410 |
| Nip Amount [mm] | 0.6 | 1.3 | 0.6 | 1.3 |
| Abrasion of Toner Feeding Roller [mm] | 0.12 | 0.14 | 0.08 | 0.11 |
| Increase in Toner Layer Potential [V] | 5 | 1 | 6 | 3 |
| Increase in Toner Attachment [mg/cm$^2$] | 0.03 | 0.01 | 0.04 | 0.02 |
| Printing Density Difference [O.D.] | 0.07 | 0.08 | 0.10 | 0.06 |
| Existence of Smear in Halftone Printing | No | No | No | No |

TABLE 5

| Table 5 | Experiment Example 37 | Experiment Example 38 | Experiment Example 39 | Experiment Example 40 | Experiment Example 41 |
|---|---|---|---|---|---|
| Presence of Coating Layer | No | Yes | Yes | Yes | Yes |
| Opening Occupancy Area Rate [%] | 94 | 88 | 88 | 88 | 88 |
| Asker F Hardness [degree] | 55 | 54 | 54 | 54 | 63 |
| Expansion Rate [%] | 330 | 330 | 330 | 330 | 310 |
| Nip Amount [mm] | 1.0 | 1.0 | 0.6 | 1.3 | 1.0 |
| Abrasion of Toner Feeding Roller [mm] | 0.27 | 0.21 | 0.18 | 0.22 | 0.23 |
| Increase in Toner Layer Potential [V] | 16 | 9 | 12 | 10 | 8 |
| Increase in Toner Attachment [mg/cm$^2$] | 0.09 | 0.07 | 0.10 | 0.08 | 0.05 |
| Printing Density Difference [O.D.] | 0.12 | 0.10 | 0.12 | 0.15 | 0.11 |
| Presence of Smear in Halftone Printing | Yes | No | Yes | No | No |

TABLE 5-continued

| Table 5 | Experiment Example 42 | Experiment Example 43 | Experiment Example 44 | Experiment Example 45 |
|---|---|---|---|---|
| Presence of Coating Layer | Yes | Yes | Yes | Yes |
| Opening Occupancy Area Rate [%] | 88 | 88 | 88 | 88 |
| Asker F Hardness [degree] | 48 | 63 | 63 | 48 |
| Expansion Rate [%] | 410 | 310 | 310 | 410 |
| Nip Amount [mm] | 1.0 | 0.6 | 1.3 | 0.6 |
| Abrasion of Toner Feeding Roller [mm] | 0.24 | 0.18 | 0.25 | 0.17 |
| Increase in Toner Layer Potential [V] | 12 | 9 | 8 | 17 |
| Increase in Toner Attachment [mg/cm$^2$] | 0.08 | 0.10 | 0.09 | 0.15 |
| Printing Density Difference [O.D.] | 0.10 | 0.12 | 0.17 | 0.20 |
| Existence of Smear in Halftone Printing | No | Yes | No | Yes |

TABLE 6

| Table 6 | Experiment Example 46 | Experiment Example 47 | Experiment Example 48 | Experiment Example 49 | Experiment Example 50 |
|---|---|---|---|---|---|
| Presence of Coating Layer | Yes | Yes | Yes | Yes | Yes |
| Opening Occupancy Area Rate [%] | 88 | 35 | 35 | 35 | 35 |
| Asker F Hardness [degree] | 48 | 57 | 57 | 57 | 63 |
| Expansion Rate [%] | 410 | 330 | 330 | 330 | 310 |
| Nip Amount [mm] | 1.3 | 1.0 | 0.6 | 1.3 | 1.0 |
| Abrasion of Toner Feeding Roller [mm] | 0.19 | 0.11 | 0.07 | 0.12 | 0.12 |
| Increase in Toner Layer Potential [V] | 15 | 3 | 6 | 3 | 2 |
| Increase in Toner Attachment [mg/cm$^2$] | 0.06 | 0.03 | 0.05 | 0.02 | 0.02 |
| Printing Density Difference [O.D.] | 0.14 | 0.16 | 0.19 | 0.17 | 0.20 |
| Presence of Smear in Halftone Printing | No | No | No | No | No |

| Table 6 | Experiment Example 51 | Experiment Example 52 | Experiment Example 53 | Experiment Example 54 |
|---|---|---|---|---|
| Presence of Coating Layer | Yes | Yes | Yes | Yes |
| Opening Occupancy Area Rate [%] | 35 | 35 | 35 | 35 |
| Asker F Hardness [degree] | 48 | 63 | 63 | 48 |
| Expansion Rate [%] | 410 | 310 | 310 | 410 |
| Nip Amount [mm] | 1.0 | 0.6 | 1.3 | 0.6 |
| Abrasion of Toner Feeding Roller [mm] | 0.10 | 0.09 | 0.11 | 0.07 |
| Increase in Toner Layer Potential [V] | 4 | 8 | 3 | 7 |
| Increase in Toner Attachment [mg/cm$^2$] | 0.06 | 0.05 | 0.07 | 0.12 |
| Printing Density Difference [O.D.] | 0.19 | 0.16 | 0.14 | 0.23 |
| Existence of Smear in Halftone Printing | No | No | No | No |

TABLE 7

| Table 7 | Experiment Example 55 | Experiment Example 56 | Experiment Example 57 | Experiment Example 58 |
|---|---|---|---|---|
| Presence of Coating Layer | Yes | Yes | Yes | Yes |
| Opening Occupancy Area Rate [%] | 35 | 72 | 72 | 72 |
| Asker F Hardness [degree] | 48 | 55 | 55 | 65 |
| Expansion Rate [%] | 410 | 330 | 330 | 310 |
| Nip Amount [mm] | 1.3 | 0.5 | 1.4 | 1.0 |
| Abrasion of Toner Feeding Roller [mm] | 0.10 | 0.08 | 0.15 | 0.21 |
| Increase in Toner Layer Potential [V] | 5 | 8 | 12 | 11 |
| Increase in Toner Attachment [mg/cm$^2$] | 0.04 | 0.06 | 0.05 | 0.09 |
| Printing Density Difference [O.D.] | 0.18 | 0.24 | 0.20 | 0.14 |
| Presence of Smear in Halftone Printing | No | Yes | No | No |

| Table 7 | Experiment Example 59 | Experiment Example 60 | Experiment Example 61 |
|---|---|---|---|
| Presence of Coating Layer | Yes | No | No |
| Opening Occupancy Area Rate [%] | 70 | 45 | 83 |
| Asker F Hardness [degree] | 45 | 63 | 49 |
| Expansion Rate [%] | 440 | 290 | 455 |
| Nip Amount [mm] | 1.0 | 1.0 | 1.0 |
| Abrasion of Toner Feeding Roller [mm] | 0.15 | 0.24 | 0.34 |
| Increase in Toner Layer Potential [V] | 13 | 20 | 18 |
| Increase in Toner Attachment [mg/cm$^2$] | 0.13 | 0.15 | 0.18 |
| Printing Density Difference [O.D.] | 0.16 | 0.21 | 0.29 |
| Existence of Smear in Halftone Printing | No | Yes | Yes |

The foregoing results revealed that the Experiment Examples 1 to 36 each achieve excellent abrasion resistance of the toner feeding roller 2 and allow for formation of an image of extremely high quality as compared with the Experiment Examples 37 to 61. This is presumably due to conditions in which: the elastic layer 22 is coated with the coating layer 23; the area occupancy rate of the openings 22K in the area of the surface 1S is in a range from 40% to 85%; the Asker F hardness of the elastic layer 22 may be in a range from 48 degrees to 63 degrees: the expansion rate of the elastic layer 22 may be in a range from 300% to 450%; and the nip amount C by which the toner feeding roller 2 works its way into the developing roller 1 may be in a range from 0.6 mm to 1.3 mm. It was confirmed that satisfying such conditions makes it possible to ensure stability of high image quality for a long period of time while improving the abrasion resistance of the toner feeding roller 2.

The wording "to ensure stability of image quality" as used herein means, for example, that a control by which the printing density, the amount of attachment of the toner on the developing roller, or both is stably maintained is performable easily. For example, it means that a temporal correction (e.g., to reduce the printing density difference) is possible even when the difference in printing density, i.e., the printing density difference, between the front end regions and the rear end regions upon the solid printing becomes large in the Experiment Example 37 or in any other Experiment Example that involves the large printing density difference. A method of the temporal correction may include reducing a development efficiency by decreasing a voltage to be applied to the developing roller 1 while increasing the amount of toner to be fed to the developing roller 1. On the other hand, reducing the development efficiency in this manner in a state in which the amount of attachment of the toner on the surface 1S of the developing roller 1 is large may lead to an increase in undeveloped toner on the developing roller 1. A repeated printing operation under such circumstances is not preferable, in that this may result in an easier occurrence of concerns, including the smear on the pieces of paper and the toner filming on the surface 1S of the developing roller 1. In contrast, the amount of attachment of the toner on the surface 1S of the developing roller 1 is stabilized and the printing density difference is small in each of the Experiment Examples 1 to 36, making it possible to reduce a degree of adjustment of the voltage to be applied to each of the developing roller 1 and the toner feeding roller 2 and to make the necessity of performing the adjustment of the voltage to be applied thereto less frequent.

It is to be noted that a thickness of the coating layer 23 was about 15 μm before starting of the printing operation in, for example, the Experiment Example 28 according to the observation of a cross section of the coating layer 23. Following completion of the printing operation, the outer diameter of the toner feeding roller 2 was decreased by 0.13 mm as a result of the abrasion, which means that the coating layer 23 at the outermost surface 2S of the toner feeding roller 2 was disappeared and a thickness of the elastic layer 22 was also decreased by 65 μm. In the Experiment Example 28, however, the stability of the amount of toner to be fed to the developing roller 1 was maintained. This is presumably due to the coating layer 23 which was exposed on the outermost surface 2S of the toner feeding roller 2 following its entry into the cells 22A as a result of the abrasion of the elastic layer 22 and which thereby made it possible to suppress further abrasion of the elastic layer 22.

Also, a tendency was seen, as illustrated in Experiment Examples 47 to 55, in which the abrasion resistance improves but an amount of the toner G supportable by the toner feeding roller 2 becomes small and thereby the printing density difference becomes relatively large, when the area occupancy rate of the openings 22K in the area of the surface 1S falls below 40%. It was also found that the coating layer 23 becomes insufficient and thereby the abrasion resistance tends to decrease when the area occupancy rate of the openings 22K in the area of the surface 1S exceeds 85%.

Further, it was also confirmed that the Asker F hardness of the elastic layer 22 and the nip amount C by which the toner feeding roller 2 works its way into the developing roller 1 each contribute to a nip pressure applied to the developing roller 1 and each thus influence image quality. For example, a low nip pressure may reduce a triboelectric charging property of the toner G and may thereby reduce an efficiency of feeding the toner G, whereas a high nip pressure may increase a mechanical load applied to the toner G and may thereby promote releasing of the external additive in the toner G and electrostatic aggregation of the toners G, which may in turn lead to the unstable charging property of the toner G From the results obtained from the present Experiment Examples, it was confirmed that the Asker F hardness of the elastic layer 22 may be preferably in a range from 48 degrees to 63 degrees and the nip amount C by which the toner feeding roller 2 works its way into the developing roller 1 may be preferably in a range from 0.6 mm to 1.3 mm.

[3. Modification Examples]

Although the invention has been described in the foregoing by way of example with reference to the example embodiments and the Examples, the invention is not limited thereto but may be modified in a wide variety of ways.

For example, the description has been given of the example embodiment in which the image forming apparatus forms the monochrome image through transferring of only the black toner image as described above. The invention, however, is not limited thereto, and may be applied to an image forming apparatus that forms a color image. Also, the description has been given of the example embodiment in which the image forming apparatus employs the primary transfer system as described above, although any embodiment of the invention may be applied to an image forming apparatus that employs a secondary transfer system.

A series of processes described in the example embodiment and the modification examples may be performed based on a hardware (such as a circuit) or on a software (such as a program). In one embodiment where the processes are implemented based on the software, the software may contain a group of programs that causes a computer or a machine to execute each function. The programs may be incorporated in the computer or the machine in advance, or may be installed from any network or any storage medium.

The LED head in which light-emitting diodes serve as a light source is used for the exposure unit in the example embodiment and the modification examples. In an alternative embodiment, an exposure unit may be used in which any other light emitting device such as, but not limited to, a laser device is used for the light source.

Also, a description has been given of the example embodiment and the modification examples in which the image forming apparatus having a printing function corresponds to a concrete but non-limiting example of the "image forming apparatus" in one embodiment of the invention. However, the term "image forming apparatus" is not limited to the image forming apparatus having a printing function. Any of the example embodiment and the modification examples described above is applicable to an image forming apparatus that may function as a multi-function peripheral. The multi-function peripheral may include a scanner function, a facsimile function, or both, in addition to the printing function as described above.

Furthermore, the invention encompasses any possible combination of some or all of the various embodiments and the modification examples described herein and incorporated herein.

It is possible to achieve at least the following configurations from the above-described example embodiments of the invention.

(1) An image forming unit, including:

an image supporting member including a photosensitive layer, the photosensitive layer being configured to support a latent image;

a developer supporting member configured to support a developer, and perform a development process on the latent image with use of the developer; and a developer feeding member including a surface that comes into contact with the developer supporting member, and configured to feed the developer to the developer supporting member, the developer feeding member including an elastic layer, the elastic layer having a plurality of cells each including an opening that is exposed on the surface, and an area occupancy rate of the openings in area of the surface being in a range from 40% to 85%.

(2) The image forming unit according to (1), wherein the developer feeding member further includes a coating layer, the coating layer covering the elastic layer and filling a part of the cells.

(3) The image forming unit according to (1) or (2), wherein the elastic layer has an Asker F hardness in a range from 48 degrees to 63 degrees.

(4) The image forming unit according to any one of (1) to (3), wherein the elastic layer has an expansion rate in a range from 300% to 450%.

(5) The image forming unit according to any one of (1) to (4), wherein the following expression is satisfied:

$$0.6\ \text{mm} \leq (A-B) \leq 1.3\ \text{mm}$$

where A is sum in mm of a radius of the developer supporting member and a radius of the developer feeding member, and B is a distance in mm from center of rotation of the developer supporting member to center of rotation of the developer feeding member.

(6) The image forming unit according to any one of (1) to (5), wherein the elastic layer is made of a material including one of a silicone rubber and a silicone modified rubber, and the coating layer is made of a material including a silicone resin and carbon black.

(7) An image forming apparatus provided with a printing medium feeding section and an image forming unit, the printing medium feeding section being configured to feed a printing medium, and the image forming unit being configured to form an image on the printing medium fed from the printing medium feeding section, the image forming unit including:

an image supporting member including a photosensitive layer, the photosensitive layer being configured to support a latent image;

a developer supporting member configured to support a developer, and perform a development process on the latent image with use of the developer; and a developer feeding member including a surface that comes into contact with the developer supporting member, and configured to feed the developer to the developer supporting member, the developer feeding member including an elastic layer, the elastic layer having a plurality of cells each including an opening that is exposed on the surface, and an area occupancy rate of the openings in area of the surface being in a range from 40%/to 85%.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming unit, comprising:

an image supporting member including a photosensitive layer, the photosensitive layer being configured to support a latent image;

a developer supporting member configured to support a developer, and perform a development process on the latent image with use of the developer; and a developer feeding member including a surface that comes into contact with the developer supporting member, and configured to feed the developer to the developer supporting member, the developer feeding member including an elastic layer, the elastic layer having a plurality of cells each including an opening that is exposed on the surface, and an area occupancy rate of the openings in area of the surface being in a range from 40% to 85%.

2. The image forming unit according to claim 1, wherein the developer feeding member further includes a coating layer, the coating layer covering the elastic layer and filling a part of the cells.

3. The image forming unit according to claim 1, wherein the elastic layer has an Asker F hardness in a range from 48 degrees to 63 degrees.

4. An image forming unit comprising:

an image supporting member including a photosensitive layer, the photosensitive layer being configured to support a latent image;

a developer supporting member configured to support a developer, and perform a development process on the latent image with use of the developer; and a developer feeding member including a surface that comes into contact with the developer supporting member, and configured to feed the developer to the developer supporting member, the developer feeding member including an elastic layer, the elastic layer having a plurality of cells each including an opening that is exposed on the surface, an area occupancy rate of the openings in area of the surface being in a range from 40% to 85%, and the elastic layer having an expansion rate in a range from 300% to 450%.

5. An image forming unit comprising:

an image supporting member including a photosensitive layer, the photosensitive layer being configured to support a latent image;

a developer supporting member configured to support a developer, and perform a development process on the latent image with use of the developer; and a developer feeding member including a surface that comes into contact with the developer supporting member, and configured to feed the developer to the developer supporting member, the developer feeding member including an elastic layer, the elastic layer having a plurality of cells each including an opening that is exposed on the surface, and an area occupancy rate of the openings in area of the surface being in a range from 40% to 85%, wherein the following expression is satisfied:

$$0.6\ \text{mm} \leq (A-B) \leq 1.3\ \text{mm}$$

where A is sum in mm of a radius of the developer supporting member and a radius of the developer feeding member, and B is a distance in mm from center of rotation of the developer supporting member to center of rotation of the developer feeding member.

6. The image forming unit according to claim 1, wherein the elastic layer is made of a material including one of a silicone rubber and a silicone modified rubber, and the coating layer is made of a material including a silicone resin and carbon black.

7. An image forming apparatus comprising:

a printing medium feeding section configured to feed a printing medium; and the image forming unit according to claim 1, and configured to form an image on the printing medium fed from the printing medium feeding section.

8. The image forming unit according to claim 5, wherein the developer feeding member further includes a coating layer, the coating layer covering the elastic layer and filling a part of the cells.

9. The image forming unit according to claim 5, wherein the elastic layer has an Asker F hardness in a range from 48 degrees to 63 degrees.

10. The image forming unit according to claim 5, wherein the elastic layer is made of a material including one of a silicone rubber and a silicone modified rubber, and the coating layer is made of a material including a silicone resin and carbon black.

11. An image forming apparatus, comprising:

a printing medium feeding section configured to feed a printing medium; and the image forming unit according to claim 4, and configured to form an image on the printing medium fed from the printing medium feeding section.

12. An image forming apparatus, comprising:

a printing medium feeding section configured to feed a printing medium; and the image forming unit according to claim 5, and configured to form an image on the printing medium fed from the printing medium feeding section.

13. The image forming unit according to claim 1, wherein the cells are independent from each other.

14. The image forming unit according to claim 5, wherein the cells are independent from each other.

15. The image forming unit according to claim 1, wherein a mean diameter of the cells is in a range from 150 μm to 400 μm.

16. the image forming unit according to claim 5, wherein a mean diameter of the cells is in a range from 150 μm to 400 μm.

17. The image forming unit according to claim 1, wherein the elastic layer has an electrical resistance in a range from $1\times10^4\Omega$ to $1\times10^7\Omega$ upon application of minus 100 V.

18. The image forming unit according to claim 5, wherein the elastic layer has an electrical resistance in a range from $1\times10^4\Omega$ to $1\times10^7\Omega$ upon application of minus 100 V.

19. the image forming unit according to claim 2, wherein the surface has a first region coated with the coating layer and a second region exposed without being coated with the coating layer, and the area occupancy rate of the openings in the area of the surface is equivalent to an area occupancy rate of the second region in the area of the surface.

* * * * *